US007458851B2

(12) United States Patent
Montena

(10) Patent No.: US 7,458,851 B2
(45) Date of Patent: Dec. 2, 2008

(54) COAXIAL CABLE CONNECTOR WITH INDEPENDENTLY ACTUATED ENGAGEMENT OF INNER AND OUTER CONDUCTORS

(75) Inventor: Noah P. Montena, East Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/709,368

(22) Filed: Feb. 22, 2007

(65) Prior Publication Data

US 2008/0207051 A1 Aug. 28, 2008

(51) Int. Cl.
*H01R 9/05* (2006.01)

(52) U.S. Cl. ..... 439/584

(58) Field of Classification Search ..... 439/584, 439/578, 583

See application file for complete search history.

(56) References Cited

U.S. PATENT DOCUMENTS

| | | | | |
|---|---|---|---|---|
| 3,184,706 | A * | 5/1965 | Atkins | 439/584 |
| 3,328,746 | A | 6/1967 | Schumacher | |
| 3,449,706 | A | 6/1969 | Carissimi | |
| 3,520,342 | A | 7/1970 | Scheffer | |
| 3,530,425 | A | 9/1970 | Vachhani | |
| 3,668,612 | A | 6/1972 | Nepovim | |
| 3,910,673 | A | 10/1975 | Stokes | |
| 3,963,321 | A | 6/1976 | Burger et al. | |
| 4,046,451 | A | 9/1977 | Juds et al. | |
| 4,126,170 | A | 11/1978 | DeHaitre | |
| 4,138,198 | A | 2/1979 | Brown | |
| 4,173,385 | A | 11/1979 | Fenn et al. | |
| 4,241,967 | A | 12/1980 | Collins | |
| 4,296,950 | A | 10/1981 | Chamberlin | |
| 4,367,060 | A | 1/1983 | Berecz | |
| 4,433,889 | A | 2/1984 | Ratchford et al. | |
| 4,447,103 | A | 5/1984 | Werth et al. | |
| 4,481,697 | A * | 11/1984 | Bachle | 24/135 R |
| 4,549,755 | A | 10/1985 | Kot et al. | |
| 4,659,272 | A | 4/1987 | Pratt | |
| 4,674,818 | A | 6/1987 | McMills et al. | |
| 4,687,272 | A | 8/1987 | Spinner et al. | |
| 4,717,355 | A | 1/1988 | Mattis | |
| 4,824,400 | A | 4/1989 | Spinner | |

(Continued)

FOREIGN PATENT DOCUMENTS

| | | |
|---|---|---|
| GB | 2277207 | 10/1994 |

OTHER PUBLICATIONS

U.S. Appl. No. 11/322,097, filed Dec. 19, 2005, Montena.

(Continued)

*Primary Examiner*—T C Patel
*Assistant Examiner*—Vladimir Imas
(74) *Attorney, Agent, or Firm*—Marjama Muldoon Blasiak & Sullivan LLP

(57) ABSTRACT

A connector for the end of a segment of coaxial cable is provided wherein the compression connector includes a clamp that is engageable to the outer conductor of the segment of coaxial cable and a collet that can seize the center conductor of the cable, wherein the engagement of the outer conductor and the seizure of the center conductor can occur as separate steps and the center conductor can be prevented from being seized until after the outer conductor has been engaged.

53 Claims, 11 Drawing Sheets

U.S. PATENT DOCUMENTS 4,824,401 A 4/1989 Spinner
4,842,553 A 6/1989 Ingram
4,869,679 A 9/1989 Szegda
4,902,246 A 2/1990 Samchisen
4,907,924 A 3/1990 Hellon
4,960,342 A 10/1990 Chi
4,995,832 A 2/1991 Thommen et al.
5,011,432 A 4/1991 Sucht et al.
5,120,260 A 6/1992 Jackson
5,127,853 A 7/1992 McMills et al.
5,137,470 A 8/1992 Doles
5,154,636 A * 10/1992 Vaccaro et al. ..... 439/583
5,167,533 A * 12/1992 Rauwolf ..... 439/583
5,267,877 A 12/1993 Scannelli et al.
5,283,853 A 2/1994 Szegda
5,284,449 A 2/1994 Vaccaro
5,322,454 A * 6/1994 Thommen ..... 439/584
5,334,051 A 8/1994 Devine et al.
5,342,096 A 8/1994 Bachle et al.
5,354,217 A * 10/1994 Gabel et al. ..... 439/583
5,435,745 A 7/1995 Booth
5,454,675 A 10/1995 DeHaitre
5,518,420 A * 5/1996 Pitschi ..... 439/578
5,561,900 A 10/1996 Hosler, Sr.
5,571,028 A 11/1996 Szegda
5,662,489 A 9/1997 Stirling
5,681,189 A 10/1997 Dunham
5,722,856 A 3/1998 Fuchs et al.
5,766,037 A * 6/1998 Nelson ..... 439/583
5,795,188 A * 8/1998 Harwath ..... 439/583
5,802,710 A 9/1998 Bufanda et al.
5,830,009 A 11/1998 Tettinger
5,857,865 A 1/1999 Shimirak et al.
5,866,849 A 2/1999 Tuvy et al.
5,938,474 A 8/1999 Nelson
5,944,556 A 8/1999 Wlos et al.
5,980,315 A 11/1999 Matsuda et al.
5,984,723 A 11/1999 Wild
5,993,254 A 11/1999 Pitschi et al.
5,997,350 A * 12/1999 Burris et al. ..... 439/585
6,019,635 A 2/2000 Nelson
6,019,636 A 2/2000 Langham
6,032,358 A * 3/2000 Wild ..... 29/863
6,053,749 A 4/2000 Masuda et al.
6,080,015 A 6/2000 Andreescu
6,102,737 A 8/2000 Gohdes
D436,076 S 1/2001 Montena
D437,826 S 2/2001 Montena
D440,539 S 4/2001 Montena
D440,939 S 4/2001 Montena
6,234,838 B1 5/2001 Wong
6,293,824 B1 9/2001 Guerin et al.
6,298,190 B2 10/2001 Waldron et al.
6,386,915 B1 5/2002 Nelson
6,431,911 B2 8/2002 Pitschi
6,471,545 B1 10/2002 Hosler, Sr.
6,491,546 B1 12/2002 Perry
6,619,876 B2 9/2003 Vaitkus et al.
RE38,294 E 11/2003 Nattel et al.
6,692,300 B2 2/2004 Kanda et al.
6,733,336 B1 5/2004 Montena et al.
6,783,394 B1 8/2004 Holliday
6,808,415 B1 * 10/2004 Montena ..... 439/584
6,830,479 B2 12/2004 Holliday
6,840,803 B2 1/2005 Wlos et al.
6,848,941 B2 2/2005 Wlos et al.
6,884,113 B1 * 4/2005 Montena ..... 439/578
6,929,265 B2 8/2005 Holland et al.
6,939,169 B2 9/2005 Islam et al.
6,976,872 B1 12/2005 Wild et al.
7,156,696 B1 * 1/2007 Montena ..... 439/584
7,189,115 B1 * 3/2007 Montena ..... 439/584
7,311,554 B1 * 12/2007 Jackson et al. ..... 439/584
7,351,101 B1 * 4/2008 Montena ..... 439/584
2004/0219821 A1 11/2004 Makita et al.
2004/0253870 A1 12/2004 Johnson
2005/0026496 A1 2/2005 Islam et al.
2005/0029807 A1 * 2/2005 Montena ..... 285/151.1
2005/0159044 A1 7/2005 Harwath et al.
2005/0181652 A1 8/2005 Montena et al.
2006/0014425 A1 * 1/2006 Montena ..... 439/578
2006/0014426 A1 * 1/2006 Montena ..... 439/578
2006/0014427 A1 1/2006 Islam et al.
2006/0134979 A1 * 6/2006 Henningsen ..... 439/583
2006/0172571 A1 * 8/2006 Montena ..... 439/91
2006/0199431 A1 * 9/2006 Paynter ..... 439/578
2007/0087628 A1 * 4/2007 Rodrigues et al. ..... 439/585

OTHER PUBLICATIONS

U.S. Appl. No. 11/260,428, filed Oct. 27, 2005, Montena.
U.S. Appl. No. 11/505,961, filed Aug. 17, 2006, Jackson et al.
U.S. Appl. No. 11/709,363, filed Feb. 22, 2007, Montena.
U.S. Appl. No. 11/709,368, filed Feb. 22, 2007, Montena.

* cited by examiner

COAXIAL CABLE CONNECTOR WITH INDEPENDENTLY ACTUATED ENGAGEMENT OF INNER AND OUTER CONDUCTORS

FIELD OF THE INVENTION

The present invention relates generally to coaxial cable connectors, and, more particularly, to a connector for engaging, in separate steps, first the outer conductor and then the center conductor of a segment of coaxial cable.

BACKGROUND OF THE INVENTION

Coaxial cable is a typical transmission medium that is used in various modern communications networks, such as CATV networks. At present, installation techniques for coaxial cable can differ depending on various factors, such as the impedance of the cable.

During installation of 75 ohm coaxial cable for example, it is common for a connector to form a positive locking engagement with the center conductor of the cable at the same time as it engages the outer conductor of the cable. Conversely, it is rare for 50 ohm coaxial cable connectors to utilize any positive or locking engagement for the center conductor of the cable. This is because 50 ohm coaxial cable tends not to be a stoutly constructed as 75 ohm coaxial cable, and thus its center conductor would likely crumple or buckle if subjected to the engagement steps that occur with regard to 75 ohm cable.

Because 50 ohm coaxial cable cannot withstand a 75 ohm cable center conductor engagement technique, 50 ohm cable connectors instead form a contact between the center conductor of a cable segment and the collet of the connector via a spring mechanism. However, this creates low contact forces between the conductor and the collet, and although that is adequate for low power signal transmissions, it can permit oxidation, which, in turn, can disadvantageously cause intermodulation at certain frequencies and at higher transmission powers.

Most in the art are aware that intermodulation can occur under these circumstances and have opted to combat the problem by using pre-made jumpers to solder the center and outer conductors of 50 ohm coaxial cable. However, it can be difficult to correctly perform such soldering techniques, especially in a field installation setting.

Therefore, a need exists for a compression connector for coaxial cable that can effect a high contact force between the connector and the center conductor without causing damage to the coaxial cable regardless of the impedance of the cable, thus not only rendering it unnecessary to utilize a soldering technique to combat the aforementioned intermodulation problem, but actually avoiding the intermodulation problem entirely.

SUMMARY OF THE INVENTION

These are other needs are met by a method of connecting a connector to a segment of coaxial cable, wherein according to an exemplary aspect, the method comprises the steps of: (a) providing a connector that includes an opening and comprises (i) a body that has a first end, a second end and a lumen therebetween, (ii) a clamping element that is disposed within the lumen of the body; and (iii) a collet that has a first end and a second end and that is also disposed within the lumen of the body; (b) inserting a segment of coaxial cable into the connector, wherein the segment of coaxial cable includes an outer conductor and a center conductor, and wherein following the completion of step (b) the outer conductor of the cable segment is at least partially surrounded by the clamping element and the center conductor of the coaxial cable segment is at least partially disposed within the collet; (c) causing the clamping element to engage at least a portion of the outer conductor of the coaxial cable segment (e.g., by applying a first axial force onto the connector in a direction away from the opening of the connector and by substantially simultaneously or non-substantially applying a second axial force onto the connector in a direction toward the opening of the connector); (d) causing the collet to engage at least a portion of the center conductor of the coaxial cable segment (e.g., by applying an axial force onto the connector in a direction toward the opening of the connector); and (e) preventing step (d) from occurring until step (c) is completed.

In accordance with this and, if desired, other exemplary aspects, the second end of the body includes a connector interface selected from the group of connector interfaces consisting of a BNC connector, a TNC connector, an F-type connector, an RCA-type connector, a DIN male connector, a DIN female connector, an N male connector, an N female connector, an SMA male connector and an SMA female connector.

In further accordance with this and, if desired, other exemplary aspects, the connector can further comprise a nut, which surrounds the second end of the body and which can be hex-shaped. If the nut is present, the body can include an outwardly protruding ridge, wherein the nut is disposed against the protruding ridge.

In still furtherance with this and, if desired, other exemplary aspects, the first end of the collet forms a plurality of flexible fingers, wherein at least one of the flexible fingers engages at least a portion of the center conductor during step (d). In accordance with such an aspect, the connector also can further comprise a guide element, which has a first end, a second end and a lumen disposed therebetween, wherein the guide element is disposed within the body, and wherein each of the plurality of flexible fingers of the collet can have a varied diameter, including an enlarged portion that has an outer diameter greater than the diameter of the lumen of the guide element. This enlarged portion, when present, can be located outside of the lumen of the guide element prior to the completion of step (d) and located within the lumen of the guide element following the completion of step (d).

In yet still further accordance with this, and if desired, other exemplary aspects, the segment of coaxial cable can include a plurality of peaks and a plurality of valleys and the clamping element can include a plurality of peaks and a plurality of recesses, wherein during step (c) at least some of the plurality of peaks of the coaxial cable segment are engaged within at least some of the plurality of recesses of the clamping element and at least some of the plurality of peaks of the clamping element are engaged within at least some of the valleys of the coaxial cable segment. Additionally or alternatively, the lumen of the body can include a sloped surface that has an angle of taper and the clamping element can include a second sloped surface that has an angle of taper, wherein the angle of taper of the sloped surface of the lumen of the body substantially matches the angle of taper of the second sloped surface of the clamping element.

In even further accordance with this and, if desired, other exemplary aspects, the connector can further comprise a driving member that has a first end, a second end and a lumen defined therebetween, wherein the driving member is disposed within the lumen of the body and in tactile communication with the body. When present, the driving member can include a protruding ridge positioned so as to act as a stop for the first end of the body. Moreover, the driving member can include a sloped surface that has an angle of taper and the clamping element can include a first sloped surface that has an angle of taper, wherein the angle of taper of the lumen of the driving member substantially matches the angle of taper of the first sloped surface of the clamping element.

In even still further accordance with this, and, if desired, other exemplary aspects, the clamping element can be formed from a blend of an elastomeric material (e.g., silicone rubber) and at least one conductive material (e.g., a metal filament, a metal powder, and/or a nanomaterial). This blend can occur, e.g., by coating the elastomeric material with the at least one conductive material.

In yet still further accordance with this, and, if desired, other exemplary aspects, the clamping element can include an inner surface, an outer surface, a first end and a second end, wherein the inner surface has an inner diameter defined by a lumen of the clamping element, and wherein each of these surfaces and ends can be at least partially coated with at least one conductive material. If instead desired, at least one but fewer than all of these surfaces and ends can be at least partially coated with the at least one conductive material. For example, at least a portion of the inner surface and at least a portion of or substantially the entirety of the second surface can be coated with at least one conductive material.

Moreover, the segment of coaxial cable can include an outer protective jacket, wherein upon insertion of the segment of coaxial cable into the connector, the inner surface of the clamping element is in tactile communication with at least a portion of the outer conductor of the segment of coaxial cable and at least a portion of the outer protective jacket of the segment of coaxial cable. Also, the inner surface of the clamping element can include constant diameter or non-constant diameter first and second segments and/or the inner diameter of the inner surface of the clamping element can be substantially constant or can be varied. The first and second segments of the inner surface can have at least one of a different inner diameter and a different length, wherein, for example, the inner diameter of the second segment can be less than the inner diameter of the first segment and/or the length of the first segment can be less than the length of the second segment.

These are other needs also are met by another method of connecting a connector to a segment of coaxial cable, wherein according to an exemplary aspect, this other method comprises the steps of: (a) providing a connector that comprises (i) a body that has a first end, a second end and a lumen defined therebetween, (ii) a clamping element that is disposed within the lumen of the body; and (iii) a collet that has a first end and a second end and that is disposed within the lumen of the body; (b) inserting a segment of coaxial cable into the connector, wherein the segment of coaxial cable includes an outer conductor and a center conductor, and wherein following the completion of step (b) the outer conductor of the cable segment is at least partially engaged to the clamping element and the center conductor of the coaxial cable segment is at least partially disposed within the collet; (c) applying at least one axial force onto the connector that is effective to cause the clamping element to engage at least a portion of the outer conductor of the coaxial cable segment; (d) applying at least one axial force onto the connector that is effective to cause the collet to engage at least a portion of the center conductor of the coaxial cable segment; and (e) preventing step (d) from occurring until step (c) is completed.

In either of the aforementioned exemplary methods, the connector can be a compression connector or a threaded connector. These and other needs also are met by yet another method of connecting a connector to a segment of coaxial cable, wherein according to an exemplary aspect, this yet another method is specifically applicable to compression connectors and comprises the steps of: (a) providing a compression connector that comprises: (i) a body that has a first end, a second end and a lumen defined therebetween; (ii) a clamping element that is disposed within the lumen of the body; (iii) a driving member that has a first end, a second end and a lumen defined therebetween, wherein the driving member is disposed within the lumen of the body and is in tactile communication with the body, (iv) a collet that has a first end and a second end and that is disposed within the lumen of the body, and (v) a guide element that has a first end, a second end and a lumen disposed therebetween, wherein the guide element is disposed within the body; (b) inserting a segment of coaxial cable into the compression connector, wherein the segment of coaxial cable includes an outer conductor and a center conductor, and wherein following the completion of step (b) the outer conductor of the cable segment is at least partially engaged to the clamping element and the center conductor of the coaxial cable segment is at least partially disposed within the collet; (c) applying at least one axial force onto the compression connector that is effective to cause the clamping element to be radially forced, by at least one of the body and the driving member, against at least a portion of the outer conductor of the coaxial cable segment; (d) applying at least one axial force onto the compression connector that is effective to cause at least a portion of the collet to be forced into the guide element so as to cause the collet to engage at least a portion of the center conductor of the coaxial cable segment; and (e) preventing step (d) from occurring until step (c) is completed.

Still other aspects, embodiments and advantages of these exemplary aspects are discussed in detail below. Moreover, it is to be understood that both the foregoing general description and the following detailed description are merely illustrative examples of various embodiments, and are intended to provide an overview or framework for understanding the nature and character of the claimed embodiments. The accompanying drawings are included to provide a further understanding of the various embodiments, and are incorporated in and constitute a part of this specification. The drawings, together with the description, serve to explain the principles and operations of the described and claimed embodiments.

BRIEF DESCRIPTION OF THE DRAWINGS

For a fuller understanding of the nature and desired objects of the present invention, reference is made to the following detailed description taken in conjunction with the accompanying figures, wherein like reference characters denote corresponding parts throughout the views, and in which.

DETAILED DESCRIPTION OF THE INVENTION

Figure 1:
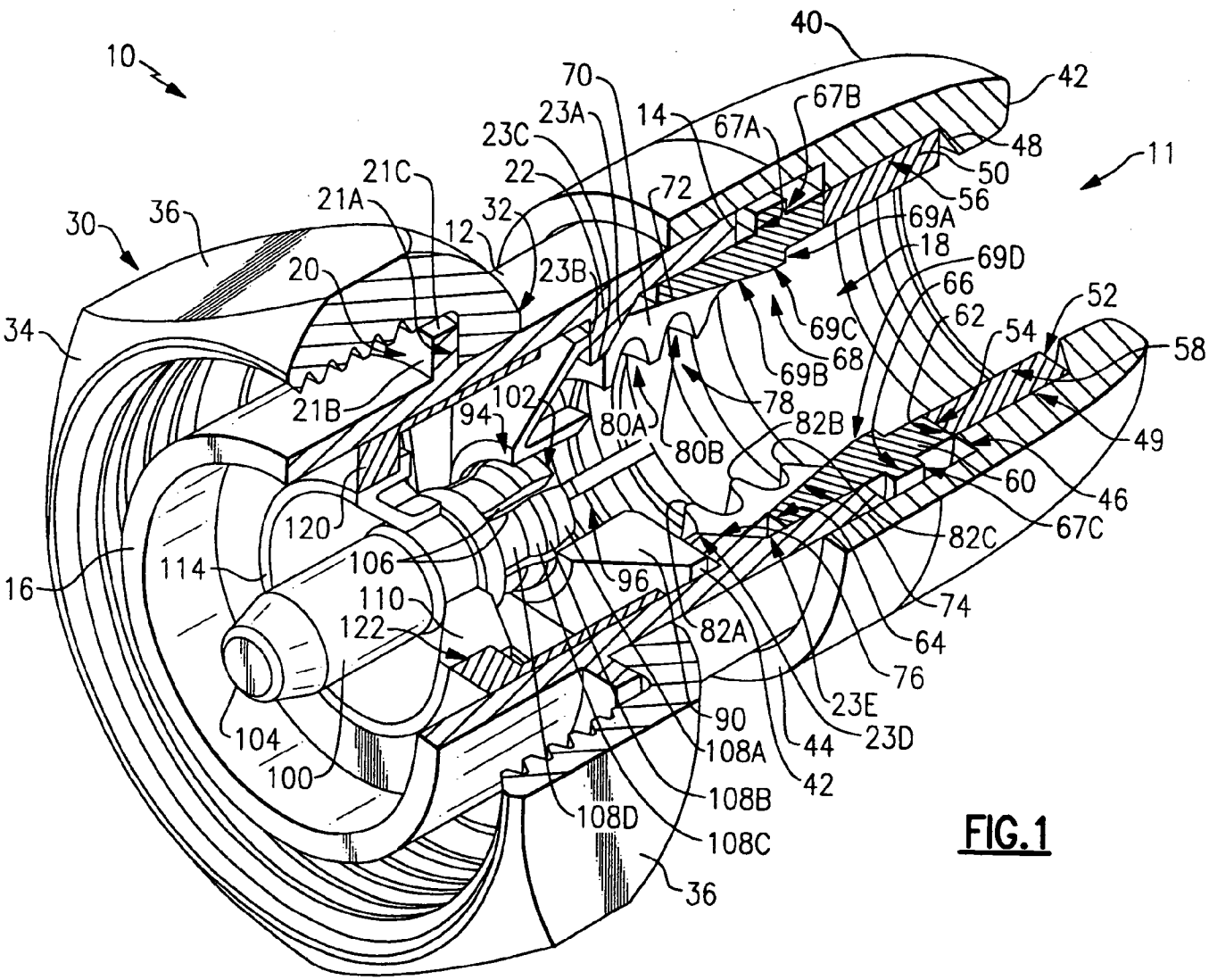
FIG. 1 is a cutaway perspective view of an exemplary embodiment of a compression connector prior to the introduction of a segment of spiral corrugated coaxial cable therewithin.

Referring initially to FIGS. 1-4, an exemplary embodiment of a compression connector 10 for a segment of spiral corrugated coaxial cable 200 (see FIGS. 2-4) is illustrated. The connector 10 includes a substantially cylindrical connector body 12, which has a first end 14, a second end 16, and a continuous lumen 18 defined therebetween. The connector 11 also includes an opening 11 into which the cable segment 200 is inserted as described in further detail below. It is understood that the terms "first end" and "second end" are used herein to refer to opposite ends of an element or object, wherein the "first end" is positioned closer to the opening 11 of the connector 10 than the "second end."

The cable segment 200 includes a protruding center conductor 202, an outer protective jacket 204, and exposed conductive corrugations shaped to define a plurality of peaks 210 and valleys 220. The peaks 210 and valleys 220 collectively form what is hereinafter referred to as the "exposed corrugated region" or "outer conductor" of the spiral corrugated coaxial cable segment 200, wherein this exposed corrugated region is denoted in FIGS. 1-4 with reference numeral 230.

A first ridge 20 protrudes outwardly from the connector body 12, whereas a second ridge 22 protrudes into the lumen 18 of the connector body. The first ridge 20 is located between the second end 16 of the body 12 and the second ridge 22, whereas the second ridge is located between the first ridge and the first end 14 of the body. By way of non-limiting example, and as shown in FIGS. 1-4, the first ridge 20 has substantially straight first and second sides 21A, 21B and a substantially straight peak 21 C defined between its sides, whereas the second ridge 22 has a substantially straight second side 23B, a substantially straight peak 23C, and a first side 23A that tapers/slopes from a taper commencement point 23D to a taper culmination point 23E on the connector body 12. The angle of taper of the sloped first side 23A of the second ridge 22 can vary; however, it is currently preferred for the angle to be substantially constant and to be between about 15° and about 60°, wherein an angle of about 45° is shown in FIGS. 1-4.

The second end 16 of the connector body 12 is surrounded by a nut 30, which has a first end 32 and a second end 34. By way of non-limiting example and as shown in FIGS. 1-4, the nut 30 can be internally threaded. The nut 30 is retained within its illustrated position by being disposed against the second side 21B of the first ridge 20 of the connector body 12. Although not shown in the Figures, a nut retaining element (e.g., a retaining ring) can be disposed around the connector body 12 and adjacent to the first end 32 of the nut 30 so as to provide added assurance that the nut will be retained in its intended position. Generally, the nut 30 is hex-shaped and includes a plurality of sides 36 to enable the nut to be grasped and manipulated by hand or by a tool (not shown) so as to couple the connector 10 to a complimentary fitting (not shown) on an equipment port.

The connector 10 further includes a compression member 40, which, by way of non-limiting example, can be in the form of a sleeve or housing. The compression member 40 has a first end 42 that defines an opening 11 of the connector 10 into which a segment of spiral corrugated coaxial cable 200 (see FIGS. 2-4) can be inserted, and further includes a second end 44, which surrounds at least a portion of the connector body 12 such that an interference fit is defined between the connector body and the compression member. The compression member 40 further includes a first internal shoulder 46 between its first end 42 and its second end 44. Also, the first end 42 of the compression member 40 can be flanged so as to create a second internal shoulder 48.

A sealing element 50 (e.g., a grommet) is disposed within the connector 10 and includes a first end 52, a second end 54, an outer surface 56 and an inner surface 58. The sealing element 50 is in tactile communication with one or more areas of the compression member 40. By way of non-limiting example, and as shown in FIGS. 1-4, the first end 52 of the sealing element 50 can be disposed against the second internal shoulder 48 at the first end 42 of the compression member, and the outer surface 56 of the sealing element 50 can be disposed against an inner surface 49 of the compression member 40 that is located between the first internal shoulder 46 and the second internal shoulder.

The connector 10 further includes a driving member 60 (e.g., a washer), which has a first end 62 disposed against the second end 54 of the sealing element 50, and a second end 64 that is surrounded by the body 12 such that an interference fit is defined between the body and the driving member. The driving member 60 is shaped to define a first, outwardly protruding ridge 66 and a second, inwardly protruding ridge 68. The first ridge 66 includes substantially straight first and second sides 67A, 67B and a substantially straight peak 67C defined between its sides, whereas the second ridge 68 has a substantially straight first side 69A, a substantially straight peak 69C, and a second side 69B that tapers/slopes from a taper commencement point 69D and culminates at the second end 64 of the driving member 60. The angle of taper of the sloped second side 69B of the second ridge 22 can vary; however, it is currently preferred for the angle to be substantially constant and to be between about 15° and about 45°, wherein an angle of about 30° is shown in FIGS. 1-4.

A clamping element 70 ("clamp") is disposed within the connector 10 and includes an outer surface 72 that has a first, first sloped section 74 and a second, second sloped section 76. The first sloped section 74 is disposed against and has an angle of taper that substantially matches that of the sloped second side 69B of the second ridge 68 of the driving member 60, whereas the second sloped section 76 is disposed against and has an angle of taper that substantially matches that of the sloped first side 23A of the second ridge 22 of the body 12.

The clamp 70 also has an inner surface 78 that is shaped to include a plurality of recessed areas ("recesses") 80, wherein each recess is defined between two of a plurality of peaks 82 defined on the clamp. As illustrated in the exemplary embodiment of FIGS. 1-4, the clamp includes two recesses 80A, 80B, wherein a second recess 80A is defined between a second peak 82A and an intermediary peak 82B, and wherein a first recess 80B is defined between the intermediary peak 82B and a first peak 82C. It is understood that the number of peaks 82 and/or recesses 80 can vary, e.g., depending on the size and shape of the segment of spiral corrugated coaxial cable 200 to which the connector 10 is to be engaged.

A guide element 90 (e.g., a seizure bushing) is disposed within the lumen 18 of the connector body 12 and includes a first end 92, a second end 94, and a continuous lumen 96 defined therebetween. The first end 92 of the guide element 90 is anchored against the non-tapering, second side 23B of the second ridge 22 of the connector body 12 so as to maintain the guide element in place. The outer diameter of the guide element 90 tapers inwardly (i.e., is reduced) toward its second end 94 such that the guide element has a flared conical shape. By way of non-limiting example, and as shown in FIGS. 1-4, the inner diameter of the lumen 96 of the guide element 90 is substantially constant and is substantially identical to the outer diameter of the guide element at its second end 94.

A collet 100 also is disposed within the connector 10 and includes a first end 102 and a second end 104. In accordance with an exemplary embodiment of the connector 10, the first end 102 of the collet 100 forms a plurality of flexible fingers or tines 106, wherein the outer surface of each finger 106 has a first, firstmost diameter portion 108A, a second diameter portion 108B second to the first diameter portion 108A, a third diameter portion 108C second to the second diameter portion 108B, and a fourth, secondmost diameter portion 108D second to the third diameter portion 108C. The effective diameter of each collet finger 106 is greatest at the second diameter portion 108B and smallest at the fourth diameter portion 108D, wherein the diameter of the first diameter portion 108A and the diameter of the third diameter portion 108C are substantially equal to each other and are less than the diameter of the second portion 108B but greater than the diameter of the fourth portion 108D. Moreover, the diameter of the second diameter portion 108B of each collet finger 106 is greater than the diameter of the lumen 96 of the guide element 90. As such, only the first diameter portion 108A, if any, of each collet finger 106 is disposed within the lumen 96 of the guide element prior to the center conductor 202 of the cable segment 200 being engaged.

The connector 10 further includes a collet support element 110 disposed around the collet 100, and an intermediary element 120 disposed between the collet support element and the connector body 12 to support the collet in place. The collet support element 110 has a substantially annular shape, as does the intermediary element 120, which also includes an internal ridge 122 disposed against the outer periphery of the collet support element.

Figure 2:
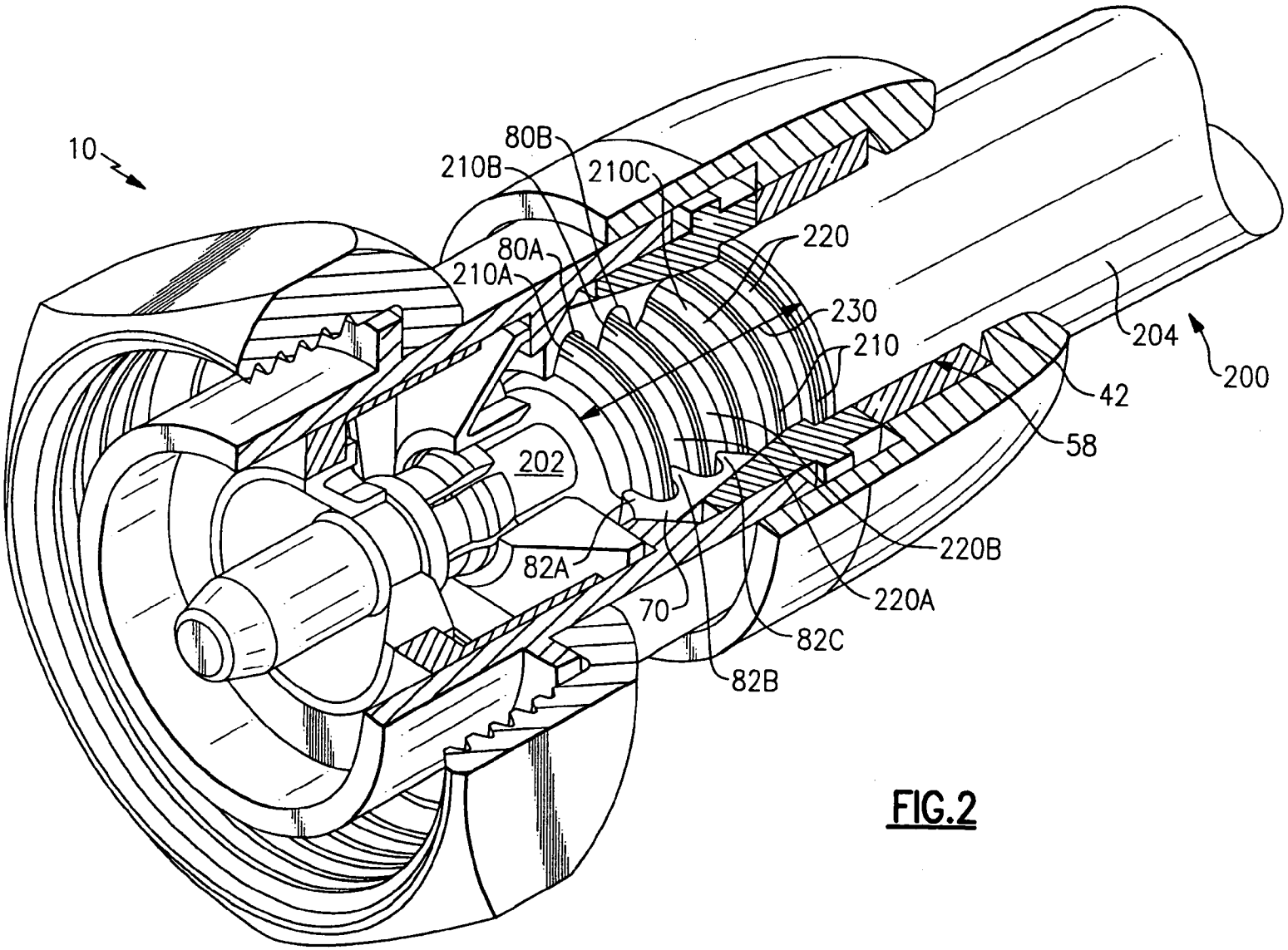
FIG. 2 is a cutaway perspective view of the compression connector of FIG. 1 after a segment of spiral corrugated coaxial cable has been inserted therewithin.

Referring now to FIG. 2, the segment of spiral corrugated coaxial cable 200 is shown having been inserted within the first opening 11 of the connector 10. The insertion process can occur entirely by hand, or either partially or entirely through use of one or more tools (not shown) such as one or more wrenches. During the insertion process, the outer conductor 230 of the cable segment 200 becomes partially engaged to the clamp 70 of the connector 10 and the outer jacket 204 of the cable segment 200 becomes surrounded both by the flanged first end 42 of the compression member 40 and the inner surface 58 of the sealing element 50. Also during the insertion process, the center conductor 202 of the cable segment 200 is advanced in a direction away from the opening 11 of the connector 10 (i.e., toward the second end 16 of the body) through the lumen 96 of the guide element 90 and into the collet 100 such that at least a portion of the center conductor remains present within the lumen of the guide element after completion of the insertion process.

The cable segment 200 becomes partially engaged to the clamp 70 by threadedly engaging the peaks 210 and valleys 220 of the cable segment 200 into the recesses 80 and peaks 82 of the clamp 70 until a secondmost peak 82A of the clamp is second but adjacent to a secondmost peak 210A of the cable segment, which is disposed within a second recess 80A of the clamp. An intermediary peak 82B of the clamp is disposed within a secondmost valley 220A of the cable segment, a second most second peak 210B of the cable segment is disposed within the first recess 80B of the clamp, and the firstmost peak 82C of the clamp is disposed within the third most second peak 210C of the cable segment.

Figure 3:
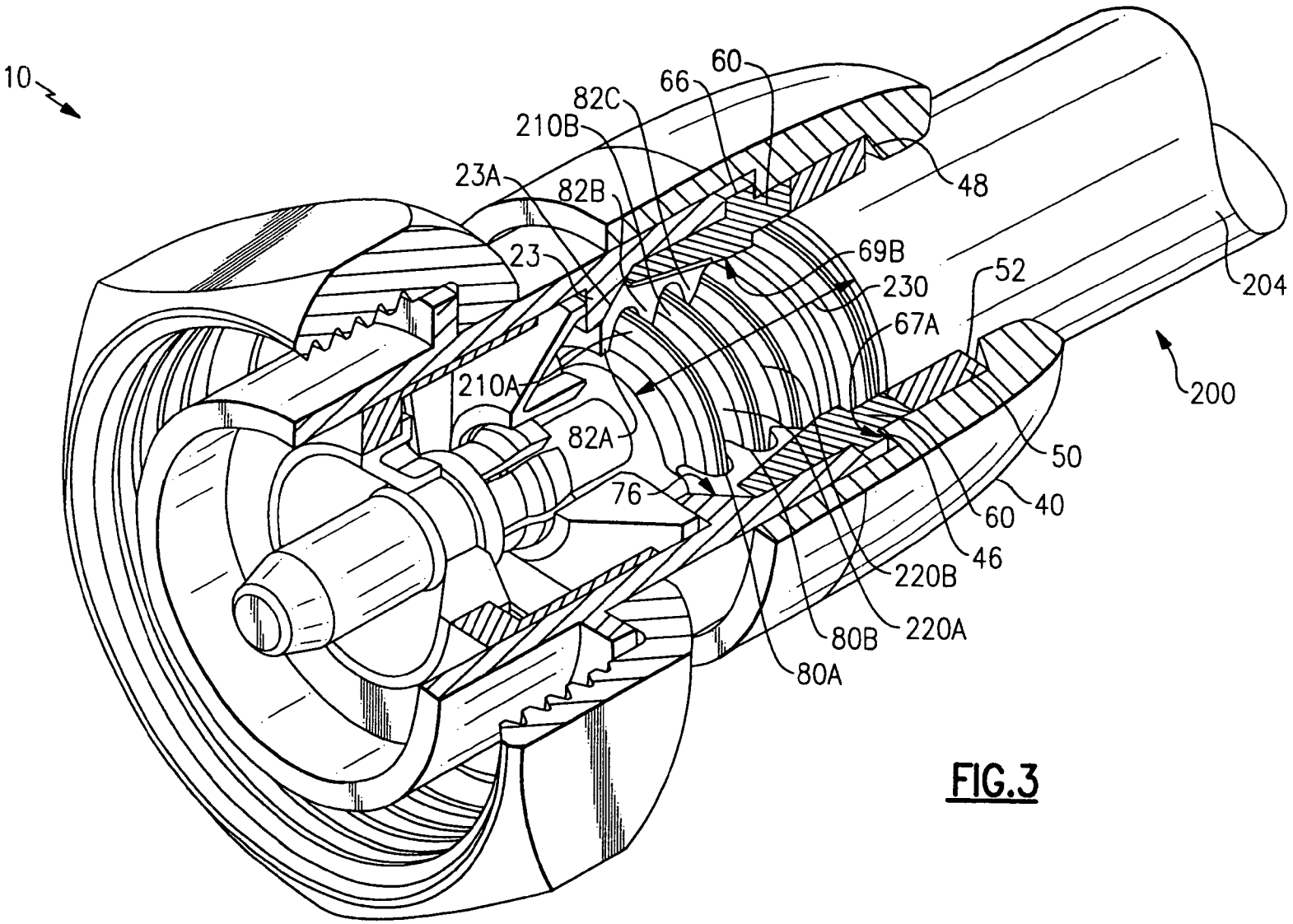
FIG. 3 is a cutaway perspective view of the compression connector of FIG. 1 after the outer conductor of the segment of spiral corrugated coaxial cable has been engaged by the connector.

Referring now to FIG. 3, the connector 10 and the inserted cable segment 200 are shown after the connector has been engaged to at least a portion of the outer conductor 230 of the cable segment. Generally, this engagement occurs or is facilitated through use of a tool (not shown) that applies axial compressive force onto the connector body 12 in a direction toward the opening 11 of the connector 10 while, at the same time, applying axial force that is sufficient to cause the compression member 40 to move axially in a direction away from the opening 11 of the connector 10. It should be noted that other techniques and/or equipment, if instead desired, can be utilized as is generally known in the art to axially move the connector body 12 in a direction toward the opening 11 of the connector 10 and/or to axially move the compression member 40 in a direction away from the opening 11 of the connector 10.

In accordance with an exemplary embodiment of the connector 10, the sealing element 50 is made of a material (e.g., rubber) that is less hard than the material (e.g., a metal-based material) from which either the compression member 40 or the driving member 60 is made. Thus, as the compression member 40 is moved axially in a direction away from the opening 11 of the connector 10, the flanged second internal shoulder 48 of the compression member 40 applies force against the first end 52 of the sealing element 50 in a direction away from the opening 11 of the connector 10 so as to cause the comparatively softer sealing element to be forced against and, in turn, be axially compressed by the first end 62 of the comparatively harder driving member 60. As this occurs, the squeezed sealing element 50 exerts radial compressive force against the outer jacket 204 of the cable segment 200. That, in turn, provides a contact force between the connector 10 and the cable segment 200. This contact force is strong enough to provide a seal that deters the entry of moisture into the connector 10, yet not so strong as to prevent some degree of beneficial flexure of the cable segment 200 from occurring without causing kinking or other damage to the cable segment.

As further shown in FIG. 3, axial movement of the compression member 40 also causes the first internal shoulder 46 of the compression member to contact the first side 67A of the first ridge 66 of the driving member 60, thus moving the driving member axially in a direction away from the opening 11 of the connector 10. That, in turn, causes the sloped second side 69B of the second ridge 68 of the driving member 60 to exert force against the matching taper first section 74 of the clamp 70, thus causing the clamp to exert radial compressive force against the outer conductor 230 of the cable segment 200 such that the respective peaks 210A, 210B of the cable segment are further engaged to/within the respective recesses 80A, 80B of the clamp and such that the respective peaks 82B, 82C of the clamp are further engaged to/within the respective valleys 220A, 220B of the cable segment.

Moreover, as this occurs, the tool also is exerting axial compressive force at the second end 14 of the body 12 in a direction toward the opening 11 of the connector 10 and such that the internal ridge 22 of the body is forced against the clamp 70. Specifically, application of this force causes the sloped, first side 23A of the ridge 22 to be forced against the matching taper second section 76 of the clamp 70. That, in turn, causes the clamp 70 to exert additional radial compressive force against the outer conductor 230 of the cable segment 200 such that the respective peaks 210A, 210B of the cable segment are still further engaged to/within the respective recesses 80A, 80B of the clamp and such that the respective peaks 82B, 82C of the clamp are still further engaged to/within the respective valleys 220A, 220B of the cable segment. Thus, the action of the tool causes the clamp 70—and thus the connector 10—to be reliably engaged to/within at least a portion of the outer conductor 230 of the cable segment 200 such that strong, reliable contact forces are created therebetween.

Figure 4:
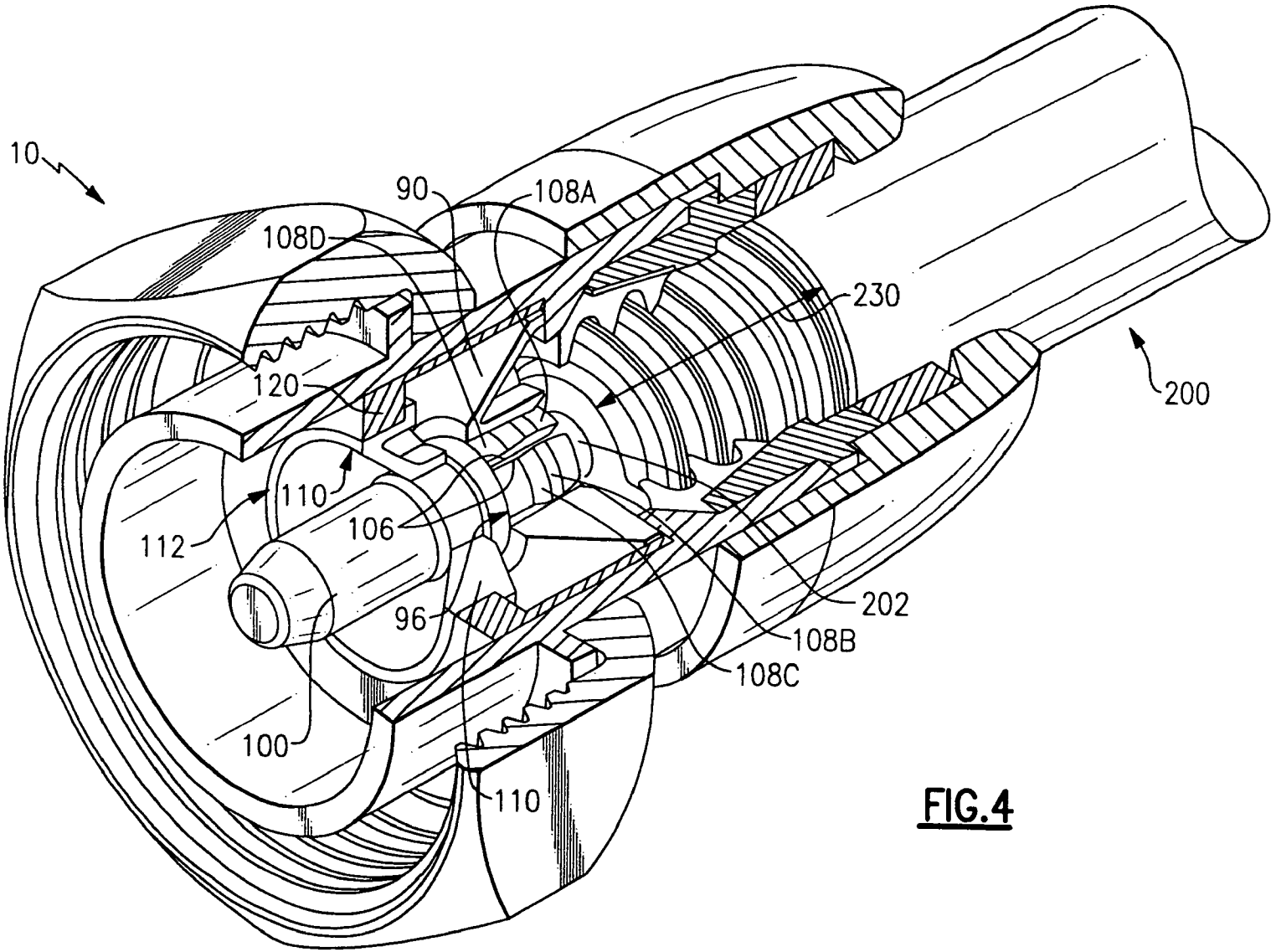
FIG. 4 is a cutaway perspective view of the compression connector of FIG. 1 after the center conductor of the segment of spiral corrugated coaxial cable has been seized by the connector.

Once the outer conductor 230 of the cable segment 200 has been engaged as such, the same tool (not shown) can be utilized to cause the connector 10 to seize the center conductor 202 of the cable segment, as shown in FIG. 4. This occurs by utilizing the tool to apply axial force against a second end 112 of the collet support element 110 in a direction toward the opening 11 of the connector 10 so as to create an axial first force against the collet 100, the collet support element 110, and the intermediary element 120 that is sufficient to move each of these elements collectively in an axial direction toward the opening 11 of the connector 10. As this occurs, the collet 100 slides over the center conductor 202, thus scraping or wiping away any residue (e.g., from foam and/or bonding agent) that is present on the outer periphery of the center conductor. This is a beneficial action, since once it occurs the center conductor 202 will be cleaner and thus more conductive.

As the collet 100 is moved in a direction toward the opening 11 of the connector 10, the second diameter portion 108B of each collet finger 106 is axially forced against the comparatively smaller diameter lumen 96 of the guide element 90. Due to this force and the flexible nature of the collet fingers 106, the second diameter portion 108B of each finger 106 is flexed inwardly so as to be forced into the lumen 96. Then, the trailing third and fourth portions 108C, 108D of the fingers are advanced into the lumen 96 as well. Once this has occurred, one or more of the diameter portions 108A, 108B, 108C, 108D of the collet fingers 106 individually and/or collectively will exert a radial compressive force against the portion of the center conductor 202 that is within the lumen 96 of the guide element 90 of the cable segment, thus causing that portion of the center conductor to become seized by/engaged to the connector 10.

Seizing the center conductor 202 in this manner is highly beneficial, since the difference in diameter between the larger diameter second portion 108B of the collet fingers 106 and the smaller diameter lumen 96 of the guide element 90 is small enough to ensure that the contact force created between the collet 100 and the center conductor is stronger than the contact force customarily created by a spring element, yet the difference in diameter also is large enough such that once the larger diameter second portion 108B of each collet finger 106 is within the lumen of the guide element 90, a detent mechanism is created to inhibit unintended withdrawal of the collet fingers 106 from the guide element and thus to maintain the contact forces between the connector 10 and the center conductor 202 of the cable segment 200.

The connector 10 also is beneficial because it can be utilized in the same manner to engage, in separate steps, the outer and center conductor of other types of coaxial cable. For example, FIGS. 5 and 6 depict a segment of annular corrugated coaxial cable 300 that can be engaged by the connector 10.

Figure 5:
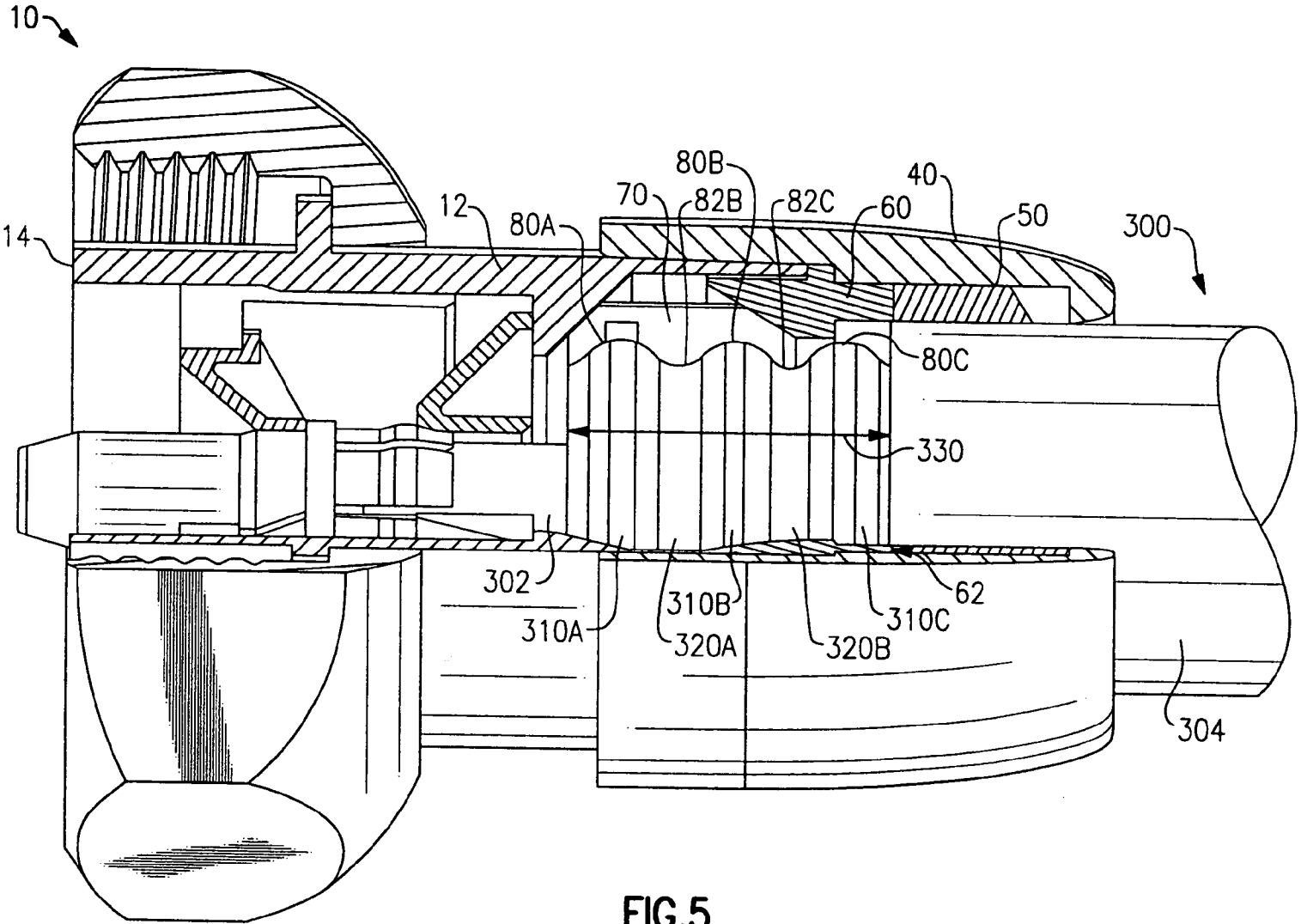
FIG. 5 is a cutaway top view of an exemplary embodiment of a compression connector that has engaged the outer conductor of a segment of annular corrugated coaxial cable.

FIG. 5 depicts an annular corrugated coaxial cable segment 300 after (a) the cable segment has been inserted into the connector 10 and (b) the clamp 70 has engaged the outer conductor 330 of the cable segment, both in the same manner as described above with respect to FIG. 3. In short, after the segment of annular corrugated coaxial cable 300 has been inserted in the connector 10, the same type of tool (not shown) as was utilized in the FIG. 3 embodiment again can be used to apply axial compressive force onto the connector body 12 in a direction toward the opening 11 of the connector 10 while, at the same time, applying axial force sufficient to cause the compression member 40 to move axially in a direction away from the opening 11 of the connector 10. As discussed above with respect to FIG. 3, the first axial force applied to the compression member 40 squeezes the elastomeric sealing element 50 between the comparatively harder compression member and driving member 60. That, in turn, causes the sealing element 50 to compress radially against the outer jacket 304 of the annular corrugated coaxial cable segment 300 and causes axial force to be applied against the first end 62 of the driving member 60 in a direction away from the opening 11 of the connector 10. In response, the driving member 60 is forced against the clamp 70, which, in turn, causes the clamp 70 to exert additional radial compressive force against the outer conductor 330 of the cable segment 300 such that the respective peaks 310A, 310B, 310C of the cable segment are further engaged to/within the respective recesses 80A, 80B, 80C of the clamp and such that the respective peaks 82B, 82C of the clamp are further engaged to/within the respective valleys 320A, 320B of the cable segment.

Moreover, as this occurs, the tool also is exerting axial compressive force at the second end 14 of the body 12 in a direction toward the opening 11 of the connector 10 and such that the internal ridge 22 of the body is forced against the clamp 70. That, in turn, causes the clamp 70 to exert additional radial compressive force against the outer conductor 330 of the annular corrugated coaxial cable segment 300 such that the respective peaks 310A, 310B, 310C of the cable segment are still further engaged to/within the respective recesses 80A, 80B, 80C of the clamp and such that the respective peaks 82B, 82C of the clamp are still further engaged to/within the respective valleys 320A, 320B of the cable segment.

Figure 6:
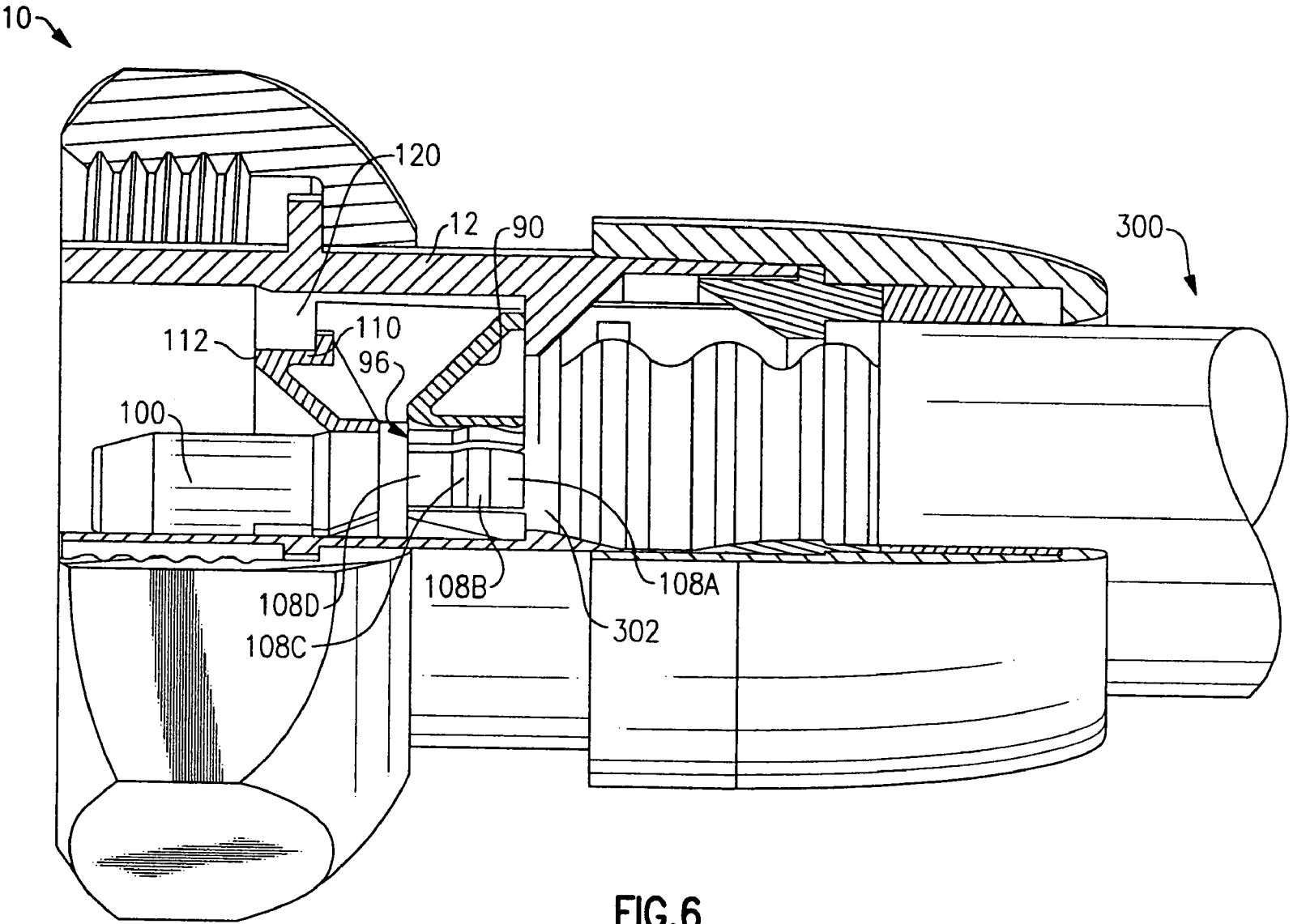
FIG. 6 is a cutaway top view of the compression connector of FIG. 5 that has seized the center conductor of a segment of annular corrugated coaxial cable.

FIG. 6 depicts the annular corrugated coaxial cable segment 300 after a portion of its center conductor 302 has been seized by the connector 10. This too can occur in the same manner as described above with respect to FIG. 4. In short, axial force applied against a second end 112 of the collet support element 110 in a direction toward the opening 11 of the connector 10 creates an axial force against the collet 100, the collet support element, and the intermediary element 120 that is sufficient to axially move each of these elements collectively in an axial direction toward the opening 11 of the connector 10. As the collet 100 is moved axially in a direction toward the opening 11 of the connector 10, the second diameter portion 108B of each collet finger 106 is flexed inwardly so as to be forced into the comparatively smaller diameter lumen 96 of the guide element 90. Then, the trailing third and fourth diameter portions 108C, 108D of the fingers 106 are advanced into the lumen 96 as well. As this occurs, one or more of the diameter portions 108A, 108B, 108C, 108D of the collet fingers 106 individually and/or collectively exert a radial compressive force against the portion of the center conductor 302 that is within the lumen 96 of the guide element 90 of the connector 10, thus causing that portion of the center conductor to become seized by/engaged to the connector.

Figure 7:
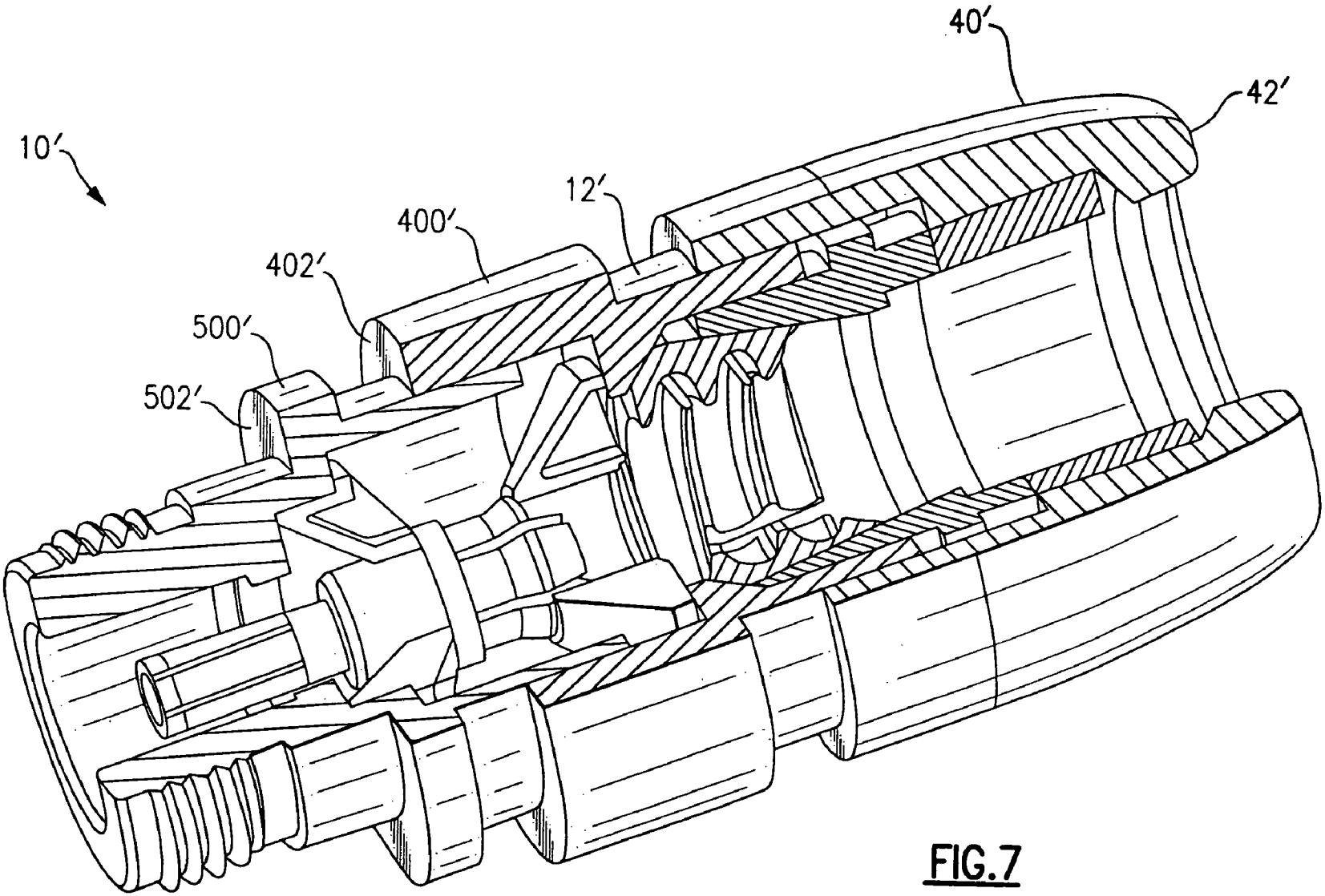
FIG. 7 is a cutaway perspective view of a first alternate embodiment of a compression connector for a segment of spiral corrugated coaxial cable.
Figure 8:
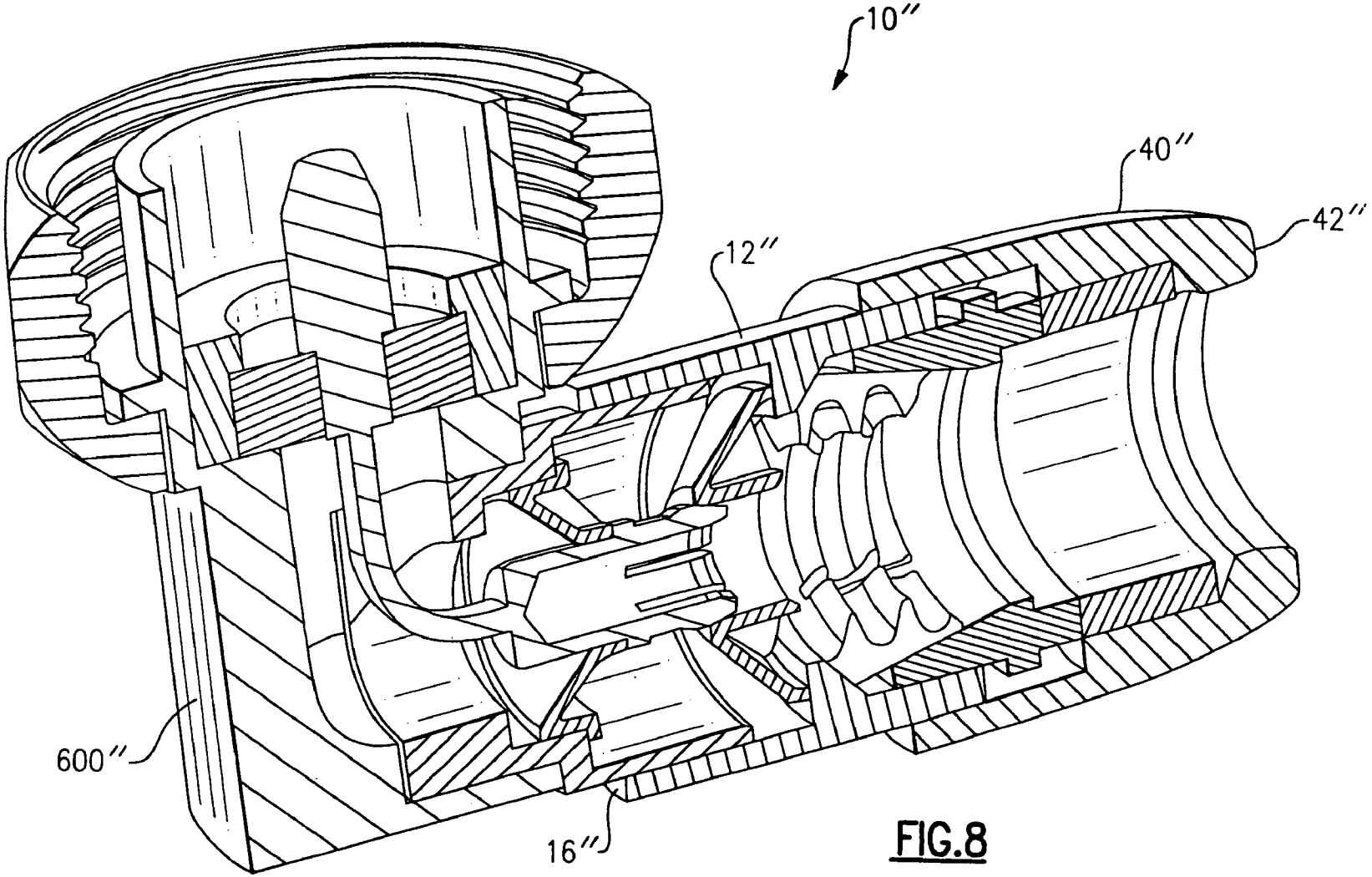
FIG. 8 is a cutaway perspective view of a second alternate embodiment of a compression connector for a segment of spiral corrugated coaxial cable.

Referring now to FIGS. 7 and 8, two additional alternate embodiments of a compression connector are shown. In FIG. 7, the connector 10' has a different interface than in FIGS. 1-6. Specifically, FIG. 7 depicts the connector 10' having an N-female connector interface 400, whereas FIGS. 1-6 depicted the connector having a DIN male connector interface. The connector 10' of FIG. 7 can be utilized in the same manner as described above with respect to FIGS. 1-6—that is, the connector 10' of FIG. 7 can be utilized to engage the clamp 70 to the outer conductor of a segment of coaxial cable (not shown) and, after that occurs, to cause the collet 100 to seize the center conductor of the segment of coaxial cable.

Referring now to FIG. 8, yet another exemplary embodiment of the connector 10" is shown wherein the connector has a DIN male type interface just as it did in FIG. 1-6, but it also has a right angle shape. In this embodiment as well, the connector 10" can be utilized to engage the clamp 70 to the outer conductor of a segment of coaxial cable (not shown) and, after that occurs, to cause the collet 100 to seize the center conductor of the segment of coaxial cable.

Although not illustrated, it is understood that the connector 10 of FIGS. 1-6, the connector 10' of FIG. 7, and/or the connector 10" of FIG. 8 can have other connector interfaces as well, including but not limited to, a BNC connector interface, a TNC connector interface, an F-type connector interface, an RCA-type connector interface, a DIN female connector interface, an N male connector interface, an SMA male connector interface, and an SMA female connector interface.

As discussed above, and by way of non-limiting example, a tool (not shown) can be used to cause the each of the various connectors 10, 10', 10" to become engaged to/within the outer conductor of a cable segment and then, only after connector has engaged the outer conductor, to seize/engage the center conductor of the cable segment. An exemplary such tool is depicted and described in commonly owned and co-pending U.S. patent application Ser. No. 11/677,600, which was filed on Feb. 22, 2007. If desired, and as is currently preferred, the tool can be used to ensure that the center conductor of a cable segment is engaged/seized only after the outer conductor of the cable segment has been engaged. This is beneficial since if the center conductor of a cable segment was seized prior to or while the outer conductor of the cable segment is being engaged, then the sensitive center conductor of the cable segment (especially a 50 ohm cable segment) could be harmed during the process of engaging the outer conductor of the cable segment.

The tool is able to ensure that the center conductor of a cable segment is seized after the outer conductor of the cable segment is engaged due to the presence of a die spring or other like element of the tool. Only after the die spring is triggered or otherwise actuated can the necessary steps be taken to engage the center conductor of the cable segment. By way of example, the tool can be positioned and pre-set such that the die spring can be actuated only after a certain level of resistance is sensed, wherein this level of resistance would be set so as to be encountered only once the outer conductor of the cables segment is completely engaged.

For example, such a tool can be used in accordance with the embodiments of the connectors 10, 10', 10" shown in FIGS. 1-8. To that end, the tool is placed in communication with three separate exemplary placement locations on the FIGS. 1-6 connector 10, namely a first exemplary placement location against the first end 42 of the compression member 40, a second exemplary placement location against the second end 16 of the body, and a third exemplary placement location at the second end 112 of the collet support element 110. For the FIG. 7 connector 10', the tool also is placed in communication with three separate exemplary placement locations, namely a first exemplary placement location at the first end 42' of the compression member 40', a second exemplary placement location against a second side 402' of a first outwardly protruding ridge 400' of the connector body 12', and a third exemplary placement location against a second side 502' of a second outwardly protruding ridge 500' of the connector body 12'. For the FIG. 8 connector 10", the tool (not shown) also is placed in communication with three separate exemplary placement locations, namely a first exemplary placement location at the first end 42" of the compression member 40", a second exemplary placement location against the bottom portion of the second end 16" of the connector body 12", and a third exemplary placement location against an upwardly extending side 600" of the connector.

For each of the FIG. 1-6, FIG. 7 and FIG. 8 exemplary embodiments, the tool can apply axial force in a direction away from the opening 11, 11', 11" of the connector 10, 10', 10" at the first exemplary placement location, and axial force in a direction toward the opening 11, 11', 11" of the connector 10, 10', 10" at both the second exemplary placement location and the third exemplary placement location, each without requiring repositioning of the tool—that is, the tool is capable of simultaneously applying axial force at each of the three exemplary placement locations. However, it would be disadvantageous for these forces to take effect simultaneously, since that could cause the center conductor of a cable segment to be seized prior to or at the same time as the outer conductor is engaged. That, in turn, and as noted above, could lead to the sensitive center conductor of the cable segment (especially a 50 ohm cable segment) being harmed during the process of engaging the outer conductor.

To address this potential problem, the tool is adapted to ensure that seizure of the center conductor of cable by the connector 10, 10', 10" occurs only after the outer conductor has been engaged. It is not necessary for the tool to be repositioned in order for this to occur; instead, the tool is simultaneously placed at each of its three exemplary placement locations and axial force is applied by the tool in a direction away from the opening 11, 11', 11" of the connector 10, 10', 10" at the first exemplary placement location, and in a direction toward the opening 11, 11', 11" of the connector 10, 10', 10" at each of the second exemplary placement location and the third exemplary placement location. However, the tool includes a die spring or other like device to prevent application of axial force in a direction toward the opening 11, 11', 11" of the connector 10, 10', 10" at the third exemplary placement location until after the outer conductor of the cable segment has been engaged by the connector 10, 10', 10". The tool can include a sensing element to determine when the outer conductor of a cable segment has been engaged by measuring or gauging the resistance provided by the connector against the tool during the process of engaging the outer conductor. As the outer conductor of the cable segment is being engaged, the resistance level will remain constant or will increase slowly. However, once the outer conductor of the cable segment is fully engaged by the connector 10, 10', 10", the resistance will increase sharply. The sensing device of the tool is calibrated to release the die spring once the resistance increases sharply as such, and the release of the die spring automatically allows the tool to apply its stored axial force in a direction toward the opening 11, 11', 11" of the connector 10, 10', 10" at the third exemplary placement location. That, in turn, and as discussed above, causes the connector to seize at least a portion of the center conductor of the cable segment.

In sum, the compression connectors 10, 10', 10" described and depicted in FIGS. 1-8 are highly beneficial in that they seize the center conductor of a segment of coaxial cable only after the outer conductor of the cable segment has been engaged by the connector. This is advantageous because it minimizes the risk of damage to the sensitive center conductor of a cable segment (especially a 50 ohm cable segment), yet it also provides stronger contact forces between the connector and the center conductor of the cable segment than would be present if, as conventionally occurs, a spring is used to create the contact forces between the center conductor and the connector. Moreover, just prior to center conductor being seized, its outer periphery is wiped/scraped by the advancing collet, thus ridding the outer periphery of the center conductor of the cable segment of debris such as foam and/or bonding agent that could otherwise inhibit the conductivity of the center conductor of the cable segment.

Figure 9:
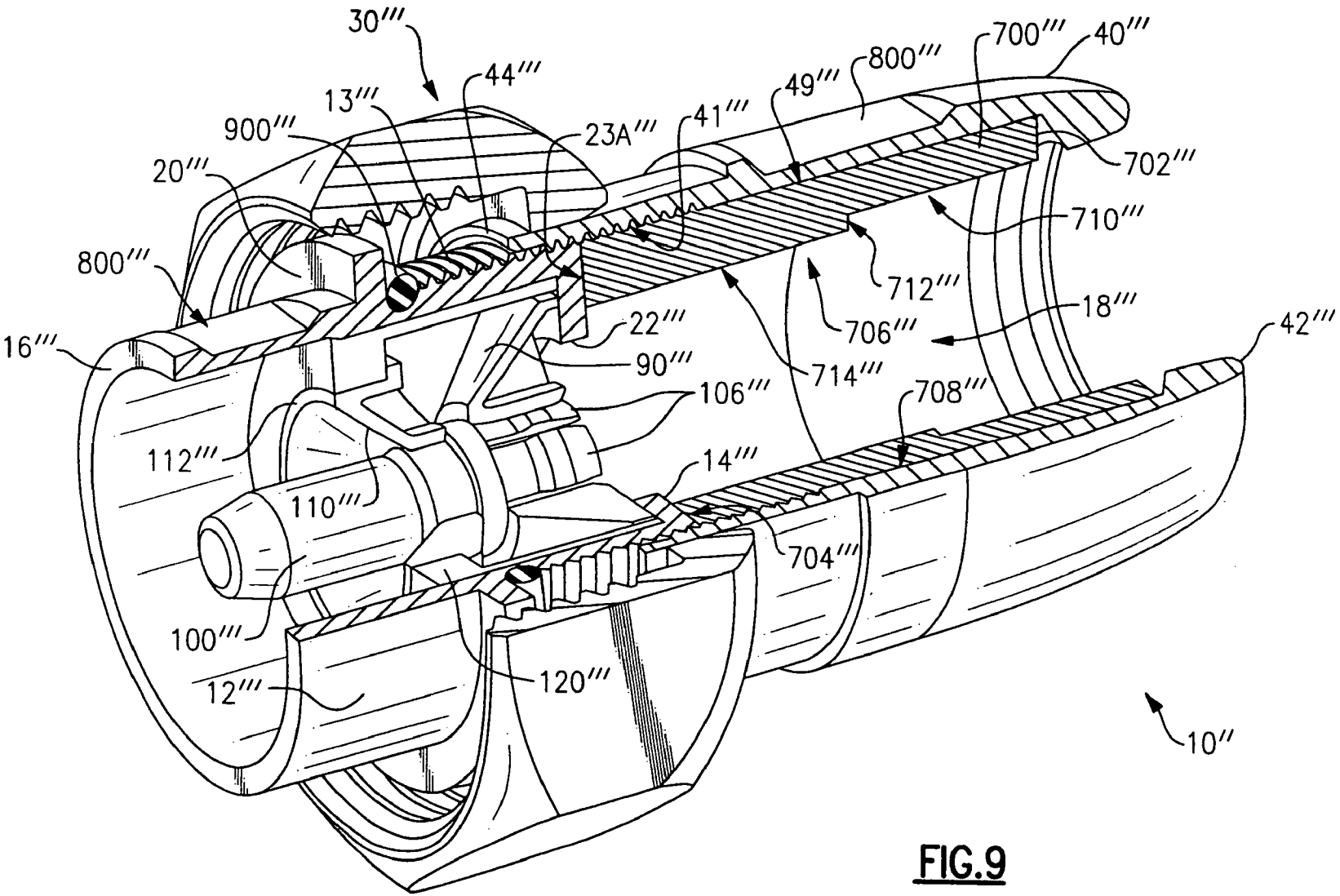
FIG. 9 is a cutaway perspective view of an exemplary threaded connector for a segment of inserted coaxial cable.
Figure 10:
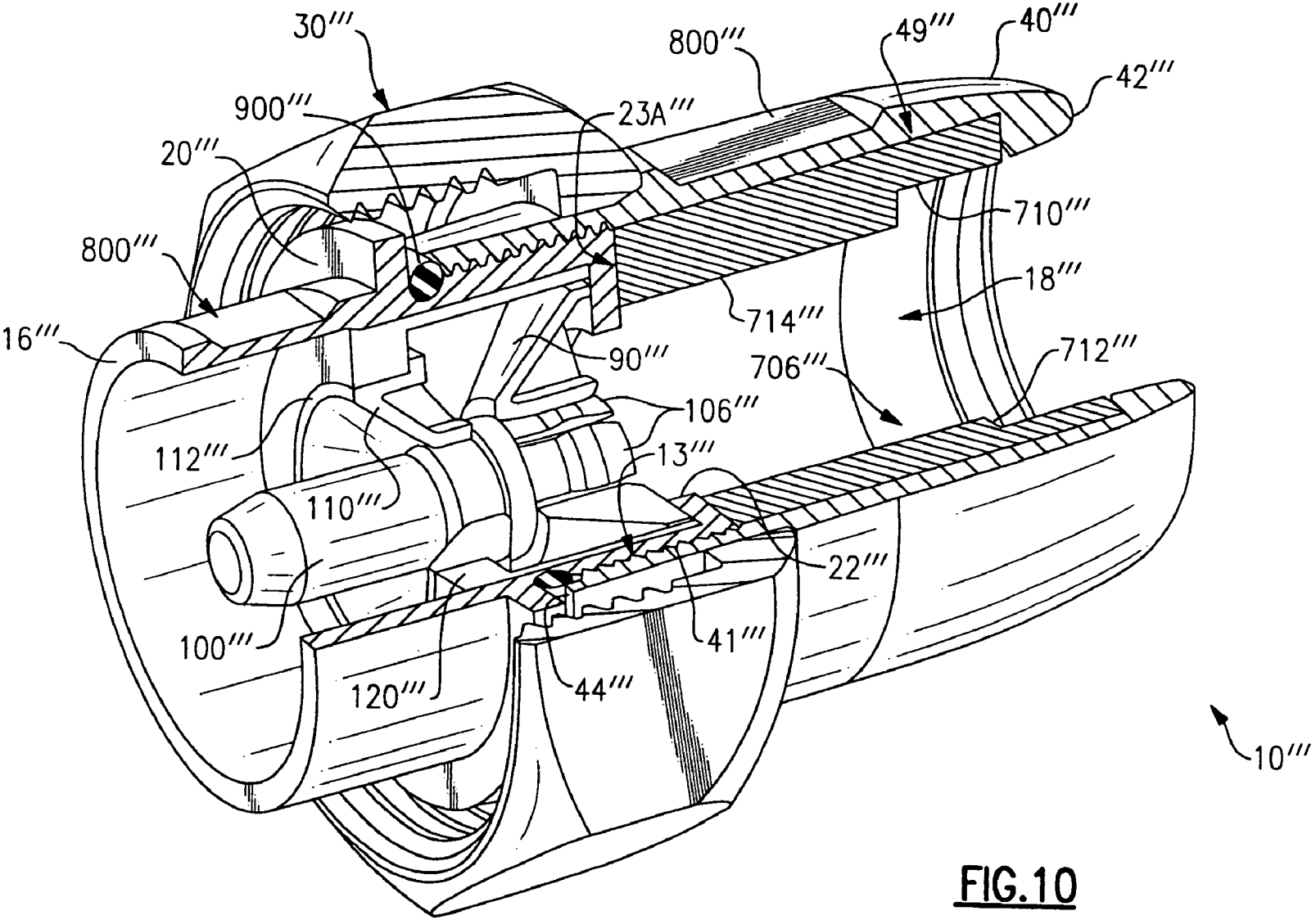
FIG. 10 is a cutaway perspective view of the threaded connector of FIG. 9 in a condition after the outer conductor of a segment of inserted coaxial cable has been engaged thereby.
Figure 11:
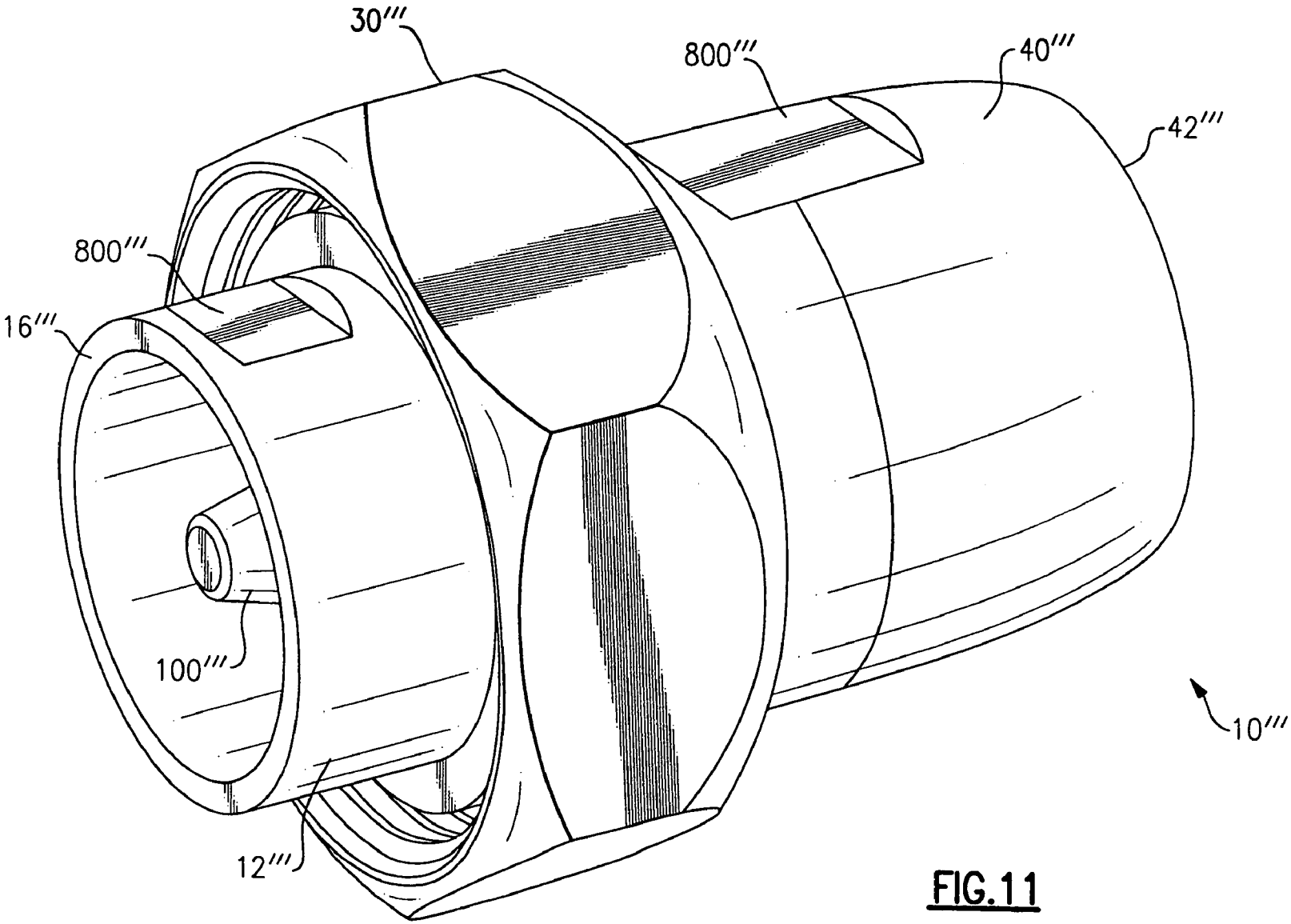
FIG. 11 is a perspective view of the exemplary threaded connector of FIG. 9.

The embodiments depicted in FIGS. 1-8 are directed to compression connectors for coaxial cable. FIGS. 9-11, however, illustrate an exemplary embodiment directed to a threaded connector 10''' for a segment of coaxial cable, such as corrugated coaxial cable.

The exemplary threaded connector 10''' includes various components similar or identical to those described in one or more of the FIGS. 1-8 compression connectors 10, 10', 10". For example, the threaded connector 10''' includes a connector body 12''' having a first end 14''', a second end 16''', a continuous lumen 18''' between the first and second end, a first, outwardly protruding ridge 20''' and a second, inwardly protruding ridge 22'''. The second end 16''' of the threaded connector 10''' is surrounded by a nut 30''', and the first end 14''' of the threaded connector is surrounded by a compression member 40''' having a flanged first end 42''' and a second end 44'''. The threaded connector 10''' further includes a guide element 90''' and a collet 100''', both of which are disposed within the lumen 18''' of the connector body 12'''.

The design and interaction of these various components are similar to those described above with respect to FIG. 1-8, except for a few exemplary differences. As shown in FIGS. 9 and 10, a portion 41''' of the compression member 40''' is threaded, as is a portion 13''' of the outer surface of the connector body, wherein the threading of such portions 13''', 41''' is complimentary so as to allow them to be threadedly engageable to one another. The specific locations of the threaded portions 13''', 41''' can vary (e.g., according to the size of the connector and/or the segment of coaxial cable); however, as illustrated in the exemplary embodiment of FIGS. 9-11, the threaded portion 13''' of the body 12''' is located on the outer surface of the body between the first and second ridges 20''', 22''', whereas the threaded portion 41''' of the compression member 40''' is located at the inner surface at the second end 44''' of the compression member. Such locations allow the threaded portions 13''', 41''' to be easily and reliably threadedly engaged to one another.

As shown in FIGS. 9 and 10, and in accordance with an exemplary embodiment, the threaded connector 10''' includes a unitary clamping element 700''' ("clamp") in place of the collective sealing element, driving member and clamping element that are present in the exemplary embodiments of the compression connectors 10, 10', 10" depicted in FIG. 1-8—that is, the clamping element 700''' of the threaded connector 10''' serves, by itself, the roles of the sealing element and clamping element of exemplary compression connectors of FIG. 1-8, and renders the presence of a driving member unnecessary.

The clamping element 700''' has a first end 702''', a second end 704''', an inner surface 706''' and an outer surface 708'''. The first end 702''' of the clamping element 700''' is disposed against the flanged first end 42''' of the compression member 40''' and the second end 704''' of the clamping element is disposed against the substantially straight first side 23A''' of the internal ridge 22 of the connector body. The outer surface 708''' of the clamping element 700''' is disposed against the inner surface 49''' of the compression member 40''', including against at least some of the threaded portion 41'''.

The inner surface 706''' of the clamping element 700''' has an effective inner diameter which can be constant or, if instead desired, can vary. FIGS. 9-11 depict an exemplary embodiment of the threaded connector 10''' in which the inner diameter of the inner surface 706''' of the clamping element 700''' varies such that its inner diameter is substantially constant within both a first constant inner diameter segment 710''' that is located between the first end 702''' of the clamping element and a transition shoulder 712''' and a second constant inner diameter segment 714''' that is located between the second end 704''' of the clamping element and the transition shoulder.

The effective inner diameter of the inner surface 706''' of the clamping element 700''' can be the same or different for the first and second constant inner diameter segments 710''', 714'''. However, according to the exemplary embodiment shown in FIGS. 9-11, the inner diameter of the second constant inner diameter segment 714''' is less than the inner diameter of the first constant inner diameter segment 710'''. Moreover, in further accordance with the exemplary embodiment of FIGS. 9-11, the length of the first constant inner diameter segment 710''' is less than the length of the second constant inner diameter segment 714'''. These exemplary relationships between the lengths and inner diameters of the inner diameter segments 710''', 714''' are beneficial in that they enable the clamping element 700''' to securely engage—at an ideal position—a segment of corrugated coaxial cable, as will be explained in further detail below.

It is currently preferred for at least certain portions of the clamping element 700''' to be both flexible and conductive. The flexibility characteristic of the clamping element 700''' enables a coaxial cable segment—especially a segment of corrugated coaxial cable—to be easily insertable into the threaded connector 10''' and also allows the clamping element to be deformable so as to fit precisely within the alternating peaks and valleys of an exposed corrugation region of the corrugated coaxial cable segment. To that end, the clamp 700''' generally should exhibit elastomeric behavior over a temperature range of about −40° C. to about 65° C. The conductivity characteristic of the clamp 700''' is beneficial as well in that it will not inhibit the necessary electrical connection from occurring between a corrugated coaxial cable segment and the connector 10''', yet also will act as an RF shield. To that end, the clamp 700''' should exhibit bulk or surface conductivity values similar to those of 360 Brass.

The desired combination of flexibility and conductivity characteristics of the clamp 700''' can be achieved in several ways. In accordance with a first exemplary embodiment, the clamp 700''' is made of an elastomeric material (e.g., silicone rubber) with which one or more conductive materials has/ have been blended or combined or in which one or more conductive materials has/have been embedded, distributed or otherwise introduced. The conductive material(s) can be introduced into or combined with the elastomeric material via a suitable technique known in the art, including, but not limited to, an impregnation, molding, doping or casting technique. In accordance with such an embodiment, the one or more conductive materials, when introduced or combined with the elastomeric material, can be in the form of one or more metal filaments (e.g., steel, brass, and/or bronze), one or more metal particles/powders (e.g., carbon, titanium, zirconium, barium, tantalum, hafnium, silicon, magnesium, manganese, aluminum, iron, chromium, and/or cobalt), and/or one or more so-called nanomaterials (e.g., carbon nanotubes, nickel-based nanomaterials, iron-based nanomaterials). By way of non-limiting example, the clamping element 700''' can be formed of silicone rubber as the elastomeric material, which is doped with carbon nanotubes as the conductive material.

In accordance with a second exemplary embodiment, a layer, coating or skin of one or more conductive materials is deposited onto at least a portion of the of the clamp 700'''. Although a coating, layer or skin of the one or more conductive materials also can be formed on some or all of the first end 702''', second end 704''', inner surface 706''' and outer surface 708''' of the clamp 700''', it is generally not necessary to do so, as discussed further below. Suitable techniques for depositing the coating of conductive material(s) onto the one or more predetermined portions of the clamp 700''' include, but are not limited to, known techniques such as thermal spray coating (e.g., combustion torch, electric arc, or plasma spraying), physical vapor deposition (e.g., ion plating, ion implantation, sputtering, laser surface alloying, laser cladding) and chemical vapor deposition.

In accordance with each of the first and second embodiments, the one or more conductive materials should be selected so as to adhere well to the elastomeric material of the clamp 700''', to not react adversely with either the elastomeric material of the clamp or the metal material (e.g., copper) of the outer conductor of a coaxial cable segment, and to provide RF shielding without also causing RF interference.

In accordance with a third exemplary embodiment, the clamping element 700''' can be formed in whole or in part from a so-called "metal rubber" conductive material. Suitable such "metal rubber" materials include but are not limited to those commercially available from Nanosonic, Inc. of Blacksburg, Va. USA.

FIG. 9 depicts the exemplary threaded connector 10''' prior to or following the introduction of a segment of coaxial cable (not shown), wherein the threaded portions 13''', 41''' of the connector body 12''' and the compression member 41''' are only partially threadedly engaged to one another. During insertion of a segment of corrugated coaxial cable (e.g., a segment of spiral corrugated coaxial cable 200 as shown in FIGS. 2-4 or a segment of annular corrugated coaxial cable 300 as shown in FIGS. 5 and 6) into the connector 10''', the corrugated peaks and valleys of the corrugated coaxial cable segment are axially advanced in a direction away from the opening 11''' of the connector 10''' until the first end of the exposed corrugated region (i.e., outer conductor) of the cable segment reaches the transition shoulder 712''' of the clamping element 700'''. The shoulder 712''' acts as a temporary stop for the cable segment, but the exposed corrugated region of the cable segment can be advanced in a direction away from the opening 11''' of the connector 10''' and past the shoulder due to the at least partially elastomeric composition of the clamp 700'''. As this further second advancement of the cable segment occurs, the various peaks and valleys of the exposed corrugated region of the cable segment become surrounded by the second constant inner diameter segment 714''' of the inner surface 706''' of the clamp 700''' such that the second constant inner diameter segment can be elastically deformed to engage the outer conductor of the segment of cable. Moreover, following insertion of the cable segment, the protective outer jacket of the cable segment is at least partially surrounded by the first constant inner diameter segment 710''' of the inner surface of the clamp to enable formation of a moisture seal between the first constant inner diameter segment and the outer jacket.

Although not shown in FIGS. 9-11, it should be noted that the second constant inner diameter segment 714''' of the inner surface 706''' could be pre-shaped to fit around the peaks and valleys of the exposed corrugated region of the corrugated coaxial cable segment—that is, rather than having a uniform shape as shown in FIGS. 9 and 10, the second constant inner diameter segment could be pre-shaped, as manufactured, to have an undulating shape so as to substantially match the size, shape and pitch of the peaks and valleys of a segment of corrugated coaxial cable. Such pre-shaping can occur as in generally known in the art, e.g., by molding.

Pre-shaping the second constant inner diameter segment 714''' can have several advantages. For one, the elastomeric material need not be as flexible as is necessary when the second constant inner diameter segment 714''' must instead deform to fit around the peaks and valleys of the corrugated coaxial cable segment. Moreover, if the second constant inner diameter segment 714''' is pre-shaped, then an installer may be better able to determine (e.g., by sound) when proper insertion of the cable segment has occurred.

FIG. 10 depicts the threaded connector 10''' after a segment of coaxial cable (not shown) has been completely inserted therein and after the outer conductor of the segment of coaxial cable has been engaged to/within the clamping element 700'''. Once these processes are complete, the respective threaded portions 13''', 41''' of the connector body 12''' and the compression member 40''' are completely threadedly engaged together. As shown in FIGS. 9 and 10, the connector 10''' can include an optional sealing element (e.g., an O-ring) 900''' for providing a seal to inhibit moisture from entering the connector 10''' between the threaded portions 13''', 41'''. To that end, and as shown in FIG. 10, the sealing element 900''' can be positioned so as to be disposed between the outwardly protruding ridge 22 and the second end 44''' of the compression member 40''' once the threaded portions 13''', 41''' of the connector body 12''' and the compression member 40''' have been threadedly engaged.

In order to completely and securely engage the clamping element 700''' to the cable segment, one or more tools (not shown) are used to apply separate axial forces upon the connector 10''' in directions both toward and away from the opening 11''' of the connector 10'''. By way of non-limiting example, a first tool (e.g., a wrench) can apply an axial force onto the connector body 12''' in a direction toward the opening 11''' of the connector 10''' while a second tool (e.g., a wrench) applies an axial force on the compression member 40''' in a direction away from the opening 11''' of the connector 10'''. In order to assist the process of completely engaging the clamping element 700''' to the cable segment, one or, as illustrated in FIGS. 10-12, both of the body 12''' and the compression member 40''' can include a gripping assistance area 800''' shaped to ensure that the body and/or the compression member can be easily and reliably gripped by the engagement tool.

As the tool(s) create axial forces on the body 12''' in a direction toward the opening 11''' of the connector 10''' and on the compression member 40''' in a direction away from the opening 11''' of the connector 10''', the body is caused to move in a direction toward the opening 11''' of the connector 10''' and the compression member is caused to move in a direction away from the opening 11''' of the connector 10'''. These axial movements individually and collectively cause the clamping element 700''' to be squeezed between the internal ridge 22''' of the connector body 12''' and the flanged first end 42''' of the compression member, thus causing the clamping element to exert a radial force. The radial force, in turn, causes the second constant inner diameter segment 714''' of the clamping element 700''' to elastically deform over the peaks and into the valleys of the segment of corrugated coaxial cable, thus engaging the outer conductor of the segment. The radial force further causes the first constant inner diameter segment 710''' of the clamping element 700''' to be pressed firmly against the outer protective jacket of the segment of corrugated coaxial cable, thus creating a seal therebetween that will effectively inhibit the ingress of moisture into the connector 10''' at that location.

To ensure that the proper conductive path exists between the connector 10''' and the engaged cable segment, at least a portion of the clamp 700''' contains or is coated with conductive material, e.g., via one or more of the techniques discussed above. By way of non-limiting example, each of the first end 702''', the second end 704''', the inner surface 706''' and the outer surface 708''' of the clamp 700''' can contain or can be coated with conductive material. However, based on the post-insertion and engagement position and shape of a cable segment with respect to the connector 10''', it is generally not necessary for the entirety of each of these areas 702''', 704''', 706''', 708''' of the clamp 700''' to be conductive. Moreover, selectively coating the clamp 700''' is beneficial, because it enables a well functioning clamp to be formed using less overall conductive material, thus, in turn, reducing the cost of manufacturing the connector 10'''.

To these ends, and in accordance with an exemplary embodiment in which the one or more conductive materials is/are formed as a coating, skin or layer on the clamping element 700''', only the entirety or substantially the entirety of the second end 704''' of the clamping element includes a skin, coating or layer of one or more conductive materials, whereas the second constant inner diameter segment 714'''of the clamping element is entirely or selectively coated with the one or more conductive materials, and wherein each of the first constant inner diameter segment 710''', the first end 702''' and the outer surface 708''' of the clamping element is either partially coated with one or more conductive materials or not coated with any conductive materials.

This selective coating of the clamping element 700''' also can occur if, instead of being present as a skin, layer or coating, the one or more conductive materials are combined with or otherwise introduced into the clamping element. In such an embodiment, and by way of non-limiting example, the conductive materials can be selectively placed within a mold so as to be present only at the desired areas of the clamp 700'''.

Once the outer conductor of the cable segment has been engaged, steps can be taken to cause the center conductor of the cable segment to be engaged or seized, such as in the manner described above with respect to the FIGS. 1-8 embodiments, namely by causing one or more of the fingers 106''' of the collet 100''' to compress radially against—and thus to seize—the center conductor of the cable segment. To that end, and in accordance with an exemplary embodiment, a tool is used to apply an axial force against a second end 112''' of the collet support element 110''' in a direction toward the opening 11''' of the connector 10''' so as to create an axial first force against the collet 100''', the collet support element 110''', and the intermediary element 120''' that is sufficient to move each of these elements collectively in an axial direction toward the opening 11''' of the connector 10'''. As this occurs, the collet 100''' slides in a direction toward the opening 11''' of the connector 10''', thus causing the collet fingers 106''' to enter the guide element 90''', which, as described above, causes the fingers to compress radially against, and thus to seize, a portion of the center conductor of the cable segment. Moreover, also as noted above, as the collet 100''' slides over the center conductor, it scrapes or wipes away any residue (e.g., from foam and/or bonding agent) that is present on the outer periphery of the center conductor. This is a beneficial action, since once it occurs the center conductor will be cleaner and thus more conductive.

Alternatively, the connector 10''' can be designed such that seizure of the center conductor of the cable segment occurs by threaded engagement. In accordance with such an embodiment, and by way of non-limiting example, a portion of the inner surface of the connector body 12''' can be threaded and a portion of the outer surface of the intermediary element 120''' can have complimentary threading. These portions can be threadedly engaged together so as to cause the collet 100''' to be advanced in a direction toward the opening 11''' of the connector 10''' to an extent whereby the collet fingers 106''' entirely or partially enter the guide element 90''' and are caused to seize the center conductor of the cable segment, such as occurs in furtherance of the other exemplary embodiments described herein.

A potential benefit of the exemplary embodiment of FIGS. 9-11 is that it is not necessary to utilize a special tool (as described above) in order to apply the axial forces required to cause engagement of the connector 10''' to the outer conductor and the center conductor of a cable segment. Instead, more common tools such as one or more wrenches can be used to threadedly engage the various threaded portions of the connector and/or to apply the necessary axial forces. However, a potential drawback to the FIGS. 9-11 embodiment is that the center conductor of the cable segment can be seized prior to the outer conductor of the cable segment. As noted above, this is disadvantageous because if the sensitive center conductor of a cable segment (especially a 50 ohm cable segment) is seized prior to or while the outer conductor is engaged, then the center conductor is in a state that is vulnerable to being damaged during the simultaneous or subsequent process of engaging the outer conductor of the cable segment. Moreover, the threaded connector 10''' depicted in FIGS. 9-11 is generally required to be longer in overall length than the compression connectors 10, 10', 10'' of FIGS. 1-8, and thus potentially more expensive to manufacture.

Although various embodiments have been described herein, it is not intended that such embodiments be regarded as limiting the scope of the disclosure, except as and to the extent that they are included in the following claims—that is, the foregoing description is merely illustrative, and it should be understood that variations and modifications can be effected without departing from the scope or spirit of the various embodiments as set forth in the following claims. Moreover, any document(s) mentioned herein are incorporated by reference in its/their entirety, as are any other documents that are referenced within such document(s).

I claim:

1. A method of connecting a connector to a segment of coaxial cable, comprising the steps of:

(a) providing a connector that includes an opening and that comprises:

a body having a first end, a second end and a bore defined therebetween;

a clamping element disposed within the bore of the body; and a collet having a first collet end and a second collet end and being disposed within the bore of the body;

(b) inserting a segment of coaxial cable into the connector, the segment of coaxial cable including an outer conductor and a center conductor, wherein following the completion of step (b) the outer conductor of the cable segment is at least partially surrounded by the clamping element, and wherein the center conductor of the coaxial cable segment is at least partially disposed within the collet;

(c) causing the clamping element to engage at least a portion of the outer conductor of the coaxial cable segment; and (d) after step (c) is completed, causing the collet to engage at least a portion of the center conductor of the coaxial cable segment.

2. The method of claim 1, wherein the second end of the body includes a connector interface selected from the group of connector interfaces consisting of a BNC connector, a TNC connector, an F-type connector, an RCA-type connector, a DIN male connector, a DIN female connector, an N male connector, an N female connector, an SMA male connector and an SMA female connector.

3. The method of claim 1, wherein the connector further comprises:

a nut surrounding the second end of the body.

4. The method of claim 3, wherein the nut is hex-shaped.

5. The method of claim 3, wherein the body includes an outwardly protruding ridge, and wherein the nut is disposed against the protruding ridge.

6. The method of claim 1, wherein the clamping element is caused to engage at least a portion of the outer conductor of the coaxial cable segment by applying a first axial force onto the connector in a direction toward the opening of the connector and by applying a second axial force onto the connector in a direction away from the opening of the connector.

7. The method of claim 6, wherein the first axial force and the second axial force are applied substantially simultaneously.

8. The method of claim 1, wherein the collet is caused to engage at least a portion of the center conductor of the coaxial cable segment by applying an axial force onto the connector in a direction toward the opening of the connector.

9. The method of claim 1, wherein the first end of the collet forms a plurality of flexible fingers, and wherein at least one of the flexible fingers engages at least a portion of the center conductor during step (d).

10. The method of claim 9, wherein the connector further comprises:

a guide element having a first end, a second end and a bore disposed therebetween, wherein the guide element is disposed within the body.

11. The method of claim 10, wherein each of the plurality of flexible fingers has a varied diameter, including an enlarged portion having an outer diameter greater than the diameter of the bore of the guide element.

12. The method of claim 11, wherein the enlarged portion is located outside of the bore of the guide element prior to the completion of step (d) and is located within the bore of the guide element following the completion of step (d).

13. The method of claim 1, wherein the segment of coaxial cable includes a plurality of peaks and a plurality of valleys and the clamping element includes a plurality of peaks and a plurality of recesses, and wherein during step (c) at least some of the plurality of peaks of the coaxial cable segment are engaged within at least some of the plurality of recesses of the clamping element and at least some of the plurality of peaks of the clamping element are engaged within at least some of the valleys of the coaxial cable segment.

14. The method of claim 1, wherein the bore of the body includes a sloped surface having an angle of taper and the clamping element includes a second sloped surface having an angle of taper, and wherein the angle of taper of the sloped surface of the bore of the body substantially matches the angle of taper of the second sloped surface of the clamping element.

15. The method of claim 1, wherein the connector further comprises:

a driving member having a first end, a second end and a bore defined therebetween, wherein the driving member is disposed within the bore of the body and in tactile communication with the body.

16. The method of claim 15, wherein the driving member includes a protruding ridge positioned so as to act as a stop for the first end of the body.

17. The method of claim 15, wherein the bore of the driving member includes a sloped surface having an angle of taper and the clamping element includes a first sloped surface having an angle of taper, and wherein the angle of taper of the bore of the driving member substantially matches the angle of taper of the first sloped surface of the clamping element.

18. The method of claim 1, wherein the clamping element is formed from a blend of an elastomeric material and at least one conductive material.

19. The method of claim 18, wherein the elastomeric material is silicone rubber.

20. The method of claim 18, wherein each of the at least one conductive material is in a form selected from the group consisting of a metal filament, a metal powder, and a nanomaterial.

21. The method of claim 18, wherein the clamping element is formed from an elastomeric material that has been coated with at least one conductive material.

22. The method of claim 21, wherein each of the at least one conductive material is in a form selected from the group consisting of a metal filament, a metal powder, and a nanomaterial.

23. The method of claim 1, wherein the clamping element has an inner surface, an outer surface, a first end and a second end, the inner surface having an inner diameter defined by a bore of the clamping element.

24. The method of claim 23, wherein each of the inner surface, the outer surface, the first end and the second end of the clamping element is at least partially coated with the at least one conductive material.

25. The method of claim 23, wherein at least one, but fewer than each of the inner surface, the outer surface, the first end and the second end of the clamping element is at least partially coated with the at least one conductive material.

26. The method of claim 25, wherein at least a portion of the inner surface and at least a portion of the second surface are coated with at least one conductive material.

27. The method of claim 26, wherein substantially the entire second surface is coated with at least one conductive material.

28. The method of claim 18, wherein the segment of coaxial cable includes an outer protective jacket, and wherein upon insertion of the segment of coaxial cable into the connector, the inner surface of the clamping element is in tactile communication with at least a portion of the outer conductor of the segment of coaxial cable and at least a portion of the outer protective jacket of the segment of coaxial cable.

29. The method of claim 18, wherein the inner diameter of the inner surface of the clamping element is substantially constant.

30. The method of claim 18, wherein the inner diameter of the inner surface of the clamping element is varied.

31. The method of claim 18, wherein the inner surface of the clamping element includes a first segment and a second segment.

32. The method of claim 31, wherein the first segment and the second segment of the inner surface have at least one of a different inner diameter and a different length.

33. The method of claim 32, wherein the inner diameter of the second segment is less than the inner diameter of the first segment.

34. The method of claim 33, wherein the first segment has a substantially constant inner diameter and the second segment has a substantially constant inner diameter less than the inner diameter of the first segment.

35. The method of claim 32, wherein the length of the first segment is less than the length of the second segment.

36. A method of connecting a connector to a segment of coaxial cable, comprising the steps of:

(a) providing a connector that includes an opening and that comprises:

a body having a first end, a second end and a bore defined therebetween;

a clamping element disposed within the bore of the body; and a collet having a first end and a second end and being disposed within the bore of the body;

(b) inserting a segment of coaxial cable into the connector, the segment of coaxial cable including an outer conductor and a center conductor, wherein following the completion of step (b) the outer conductor of the cable segment is at least partially engaged to the clamping element, and wherein the center conductor of the coaxial cable segment is at least partially disposed within the collet;

(c) applying at least one axial force onto the connector effective to cause the clamping element to engage at least a portion of the outer conductor of the coaxial cable segment;

(d) applying at least one axial force onto the connector effective to cause the collet to engage at least a portion of the center conductor of the coaxial cable segment; and (e) preventing step (d) from occurring until step (c) is completed.

37. The method of claim 36, wherein the second end of the body includes a connector interface selected from the group of connector interfaces consisting of a BNC connector, a TNC connector, an F-type connector, an RCA-type connector, a DIN male connector, a DIN female connector, an N male connector, an N female connector, an SMA male connector and an SMA female connector.

38. The method of claim 36, wherein the connector further comprises:

a nut surrounding the second end of the body.

39. The method of claim 38, wherein the nut is hex-shaped.

40. The method of claim 38, wherein the body includes an outwardly protruding ridge, and wherein the nut is disposed against the protruding ridge.

41. The method of claim 36, wherein the clamping element is caused to engage at least a portion of the outer conductor of the coaxial cable segment by applying a first axial force onto the connector in a direction toward the opening of the connector and by applying a second axial force onto the connector in a direction away from the opening of the connector.

42. The method of claim 41, wherein the first axial force and the second axial force are applied substantially simultaneously.

43. The method of claim 36, wherein the collet is caused to engage at least a portion of the center conductor of the coaxial cable segment by applying an axial force onto the connector in a direction toward the opening of the connector.

44. The method of claim 36, wherein the first end of the collet forms a plurality of flexible fingers, and wherein at least one of the flexible fingers engages at least a portion of the center conductor during step (d).

45. The method of claim 44, wherein the connector further comprises:

a guide element having a first end, a second end and a bore disposed therebetween, wherein the guide element is disposed within the body.

46. The method of claim 45, wherein the plurality of flexible fingers has a varied diameter, including an enlarged portion having an outer diameter greater than the diameter of the bore of the guide element.

47. The method of claim 46, wherein the enlarged portion is located outside of the bore of the guide element prior to the completion of step (d) and is located within the bore of the guide element following the completion of step (d).

48. The method of claim 36, wherein the segment of coaxial cable includes a plurality of peaks and a plurality of valleys and the clamping element includes a plurality of peaks and a plurality of recesses, and wherein during step (c) at least some of the plurality of peaks of the coaxial cable segment are engaged within at least some of the plurality of recesses of the clamping element and at least some of the plurality of peaks of the clamping element are engaged within at least some of the valleys of the coaxial cable segment.

49. The method of claim 36, wherein the bore of the body includes a sloped surface having an angle of taper and the clamping element includes a second sloped surface having an angle of taper, and wherein the angle of taper of the sloped surface of the bore of the body substantially matches the angle of taper of the second sloped surface of the clamping element.

50. The method of claim 49, wherein the connector further comprises:

a driving member having a first end, a second end and a bore defined therebetween, wherein the driving member is disposed within the bore of the body and in tactile communication with the body.

51. The method of claim 50, wherein the driving member includes a protruding ridge positioned so as to act as a stop for the first end of the body.

52. The method of claim 50, wherein the bore of the driving member includes a sloped surface having an angle of taper and the clamping element includes a first sloped surface having an angle of taper, and wherein the angle of taper of the bore of the driving member substantially matches the angle of taper of the first sloped surface of the clamping element.

53. A method of connecting a compression connector to a segment of coaxial cable, comprising the steps of:

(a) providing a compression connector, comprising:

a body having a first end, a second end and a bore defined therebetween;

a clamping element disposed within the bore of the body;

a driving member having a first end, a second end and a bore defined therebetween, wherein the driving member is disposed within the bore of the body and in tactile communication with the body;

a collet having a first end and a second end and being disposed within the bore of the body; and a guide element having a first end, a second end and a bore disposed therebetween, wherein the guide element is disposed within the body;

(b) inserting a segment of coaxial cable into the compression connector, the segment of coaxial cable including an outer conductor and a center conductor, wherein following the completion of step (b) the outer conductor of the cable segment is at least partially engaged to the clamping element, and wherein the center conductor of the coaxial cable segment is at least partially disposed within the collet;

(c) applying at least one axial force onto the compression connector effective to cause the clamping element to be radially forced, by at least one of the body and the driving member, against at least a portion of the outer conductor of the coaxial cable segment;

(d) applying at least one axial force onto the compression connector effective to cause at least a portion of the collet to be forced into the guide element so as to cause the collet to engage at least a portion of the center conductor of the coaxial cable segment; and (e) preventing step (d) from occurring until step (c) is completed.

* * * * *